US005408221A

United States Patent [19]

Carsella, Sr. et al.

[11] Patent Number: 5,408,221

[45] Date of Patent: Apr. 18, 1995

[54] DOWNED WATER SKIER WARNING SYSTEM

[75] Inventors: Ronald F. Carsella, Sr., Garden City, Kans.; Craig A. Coad, Denton, Tex.

[73] Assignee: Inventech, Inc., Holcomb, Kans.

[21] Appl. No.: 97,970

[22] Filed: Jul. 27, 1993

[51] Int. Cl.[6] ..... G08B 21/00

[52] U.S. Cl. ..... 340/604; 340/573; 340/539; 441/69; 116/173

[58] Field of Search ..... 340/604, 605, 539, 573, 340/984; 116/28.1, 28 R, 173, 26; 455/100; 441/69

[56] References Cited

U.S. PATENT DOCUMENTS

| | | | |
|---|---|---|---|
| 3,602,188 | 8/1971 | Penaflor | 116/132 |
| 3,735,724 | 5/1973 | Miller | 116/132 |
| 3,786,778 | 1/1974 | Palmer et al. | 116/132 |
| 3,797,450 | 3/1974 | Frisbee | 116/28 R |
| 3,798,631 | 3/1974 | Langford | 340/573 X |
| 4,090,468 | 5/1978 | D'Spain | 116/132 R |
| 4,122,796 | 10/1978 | Pressler et al. | 116/132 R |
| 4,624,141 | 11/1986 | Soleau | 340/984 X |
| 4,689,611 | 8/1987 | Franklin | 340/539 |
| 4,782,784 | 11/1988 | Little | 116/173 X |
| 4,807,557 | 2/1989 | Lodisio | 116/173 |

*Primary Examiner*—Jeffery A. Hofsass
*Attorney, Agent, or Firm*—Larry L. Uland

[57] ABSTRACT

An improved downed water skier warning system for alerting the operator of a skier tow-boat and the operators of nearby boats when a skier falls into the water or releases the skier towrope. The system includes electronic water sensors for sensing when the rope-handle of the skier tow-rope lands in the water, and pressure sensors for sensing when the water skier releases the rope handle. The water and pressure sensors are in remote communication with audible and visual tow-boat operator alarms and visual "skier-down" warning indicators, for enabling said alarms and indicators when a "downed skier" situation occurs. The improved warning system is designed for use in conjunction with marine warning devices and indicators commonly available, such as the "skier-down" flag and bow or stem directional lights.

20 Claims, 12 Drawing Sheets

DOWNED WATER SKIER WARNING SYSTEM

RELATED DISCLOSURE

This is related to the disclosure filed with the U.S. Patent and Trademark Office as part of the Disclosure Document Program on Mar. 11, 1991, having Ser. No. 275,829.

BACKGROUND OF THE INVENTION

The present invention relates to water skier alarm devices, and more particularly concerns an apparatus and system for automatically warning the operator of a skier tow-boat and the operators of nearby boats when a water skier being towed by said tow-boat either releases a skier tow-rope or falls into the water. The system of the present invention includes means for sensing when the rope-handle of a skier tow-rope is submerged in water or is otherwise released by a water skier, and means for indicating to the tow-boat operator and for warning operators of nearby boats when said skier releases said rope-handle or otherwise falls into the water.

During recent decades, water skiing has grown into a well known and extremely popular form of sport and entertainment. In this sport, a water skier standing on one or more of various forms of water skis and holding a handle end of a tow-rope is pulled across the surface of a body of water by a tow-boat to which the tow-rope is attached. Although water skiing is a relatively safe method of achieving the exhilaration that accompanies low altitude high-speed personal movement, it does entail certain elements of danger, such as boat-to-boat and boat-to-skier collisions. Unfortunately, as the popularity of the sport has increased, so has the density of water-skiers on the public waterways, which has understandably increased the risks of a skier's involvement in these dangers. Those familiar with the sport realize that the time of greatest risk is when a skier has either fallen and/or has released the tow-rope. Although it is relatively easy to spot the movement of a water skier tow-boat or a skier in-tow, it is extremely difficult to spot an individual who has fallen and/or has released the tow-rope and is "down" in the water, especially if the spotter is bouncing over the waves in a high speed boat.

To reduce the dangers associated with this period of greatest risk, many skier-down alarm devices have been proposed. Federal U.S. Coast Guard regulations and the laws of many states have dictated that the least complex of these devices become a mandatory item of use by participants in the sport. This device is the "skier-down" flag, which is to be flown by a boat whose water skier has fallen. The typical skier-down flag comprises an orange triangular pennant fixedly attached to a flag-end of a means for supporting said flag, such as a mast or flagstaff, and held up by a tow-boat operator or other person in the tow-boat during the entire time period in which a skier is down. The purpose of said skier-down flag is to alert nearby boats of the existence of a downed skier in their vicinity, and of the probability that the boat on which the skier-down flag is flying will be making maneuvers which are less predictable, as it turns to retrieve the downed skier. Many devices have been proposed to lessen the efforts required of a tow-boat operator, or said other individual in the boat, to locate, raise and hold-up said skier-down flag, such as those disclosed in the U.S. Pat. Nos. 3,786,778 (Palmer), 3,797,450 (Frisbee), 4,090,468 (D'Spain), and 4,122,796 (Pressler). In each of these is taught various means for securing to the boat, for raising, for holding in a position which is viewable by nearby boaters and lowering a skier-down flag.

Although this type of downed water skier warning device has addressed the work required by the tow-boat operator, or said other individual, it has failed to address other problems associated with this period of greatest risk, including the problem of alerting said operator or other individual to the fact that the skier has fallen and/or is down. The very nature of the operator task of maneuvering and operating a high speed tow-boat lowers his ability to ascertain the precise moment in which a skier falls. Even when an individual other than the operator is responsible for raising the skier-down flag, the lower levels of alertness that tend to accompany such a leisurely task often work to reduce the attentiveness of said individual. What makes this a critical point is that the skier-down flag is often the only warning which is visible to nearby boats pertaining to the hard-to-recognize downed skier. The longer it takes for a tow-boat operator to realize his skier is down, the farther said tow-boat and its raised downed-skier flag initially may be from said downed skier, increasing the time interval between the skier's fall and the moment in which other boaters in the vicinity recognize the potential danger.

Various efforts have been made to eliminate this particular aspect of the danger accompanying a downed skier via attempts to provide a device for automatically raising the skier-down flag after a skier has released the tow-rope, some of which are disclosed in U.S. Pat. Nos. 3,602,188 (Penaflor), 3,735,724 (Miller), 4,807,557 (Lodisio), and 3,798,631 (Langford). Each of these teach a warning device which is actuated via a type of tension-switch mechanism designed for sensing significant changes in the tension on the tow-rope between the skier's rope-handle and the tow-boat. Although each of the tension-switch actuated devices so disclosed attempt to address the problem of alerting the operator and/or other boaters after a skier has released the tow-rope, each of the devices of the prior art fails to address downed-skier problems which are resolved by the present invention. The operational basis for these tension-switch devices is the knowledge that in most situations said tension does significantly decrease when the skier drops the rope handle. However, these devices cannot alleviate problems that naturally occur when an indirect method of detecting when the water skier releases the rope-handle is utilized. Such devices fail to provide means for indicating between those planned events known to produce the downed skier alarm and those unforeseen events that can likewise precipitate said alarm, and thereby create occurrences of false alarms that tend to confuse the tow-boat operator and nearby boaters, if not actually teach outright disregard for said warning devices, vis-a-vis *The Boy Who Cried Wolf.* Various of these false alarm situations are described in conjunction with further description of examples of the prior art, below.

The disclosures of Penaflor, Lodisio and Miller each teach the use of a skier-down flag that is automatically raised when said tension has sufficiently decreased. The disclosures of Penaflor and Langford teach the actuation of a warning indicator for the tow-boat operator which is responsive to said tension-switch. Langford's disclosure does not teach the use of means for automatically raising a skier-down flag; however, it does disclose means for actuating an operator warning indicator such that said indicator cannot be turned-off until said skier-down flag is placed into means for holding said flag in an upright position, said means for holding further being mounted on the boat.

In Penaflor's disclosure a skier-down flag is mounted within a cylindrical enclosure positioned at the stern of a ski boat in which there is a spring for biasing the flagstaff upwardly out of the enclosure, for placing said skier-down flag in view of neighboring boats. The lower end of the skier-down flag is attached to a transverse line which is further attached to the skier tow-rope through an aperture in the transom of the tow-boat. As well as requiring an expensive installation, the device of this disclosure fails to take into account the often existing situation in which the tension on a skier's tow-rope is temporarily and significantly decreased, such as that which occurs when the skier comes off the crest of a wave, or when the skier has just undergone a rapid centrifugal acceleration about an arc of the tow-rope radius and is now decelerating while the tow-boat "catches-up" to the pace of the skier. Such slackening in the tow-rope tension thereby allows the spring-bias of the cylinder to move said skier-down flag up and down out of said housing, which creates a situation in which neighboring boaters have difficulty understanding the signal being delivered by the skier-down flag, and therefore may learn to ignore said flag.

The disclosure of Miller addresses some problems of Penaflor's disclosure by providing means for raising the skier-down flag which includes a pivotally mounted skier-down flag with a fluid dampened spring for biasing said flag in an up position. The skier-down flag is connected directly to a transverse line for holding the tow-rope, and is held in a down position against the upward biasing force of said spring by tension created via the skier being pulled on the tow-rope. Although the fluid dampening of the biasing spring accomplishes a lessening of the speed at which the flag is allowed to raise up and down during times of temporary slackening of the tension in the tow-rope, it fails to eliminate said temporary up and down raising. With the skier-down flag of this particular disclosure mounted in permanent view, the device of this disclosure provides yet another situation in which nearby boaters have difficulty understanding the message said skier-down flag is signaling. What makes the difference between the temporary slackening of the tow-rope and the actual release of the tow-rope by the skier even more difficult to decipher when using this device, is that a significant amount of tension is created on the rope-handle by the water itself after a skier has released said rope-handle and the tow-rope is being dragged through the water. Although the device of Miller is attractive due to its apparent simplicity, to overcome this problem of knowing the difference between actual skier-down situations and other false-alarm situations requires some training on the part of the operator.

The disclosure of Lodisio provides another attempt to overcome the problem of skier-down flags giving false alarms during temporary periods of slackened tension on the skier tow-rope. This disclosure teaches a device in which a skier-down flag is mounted within a cylinder against means for biasing said flag upward and out of said cylinder. The flag is further attached at its downward end to a pull rope which is attached to the skier tow-rope. This disclosure further teaches the provision of an aperture in the lower portion of the cylinder through which said pull rope passes. On the pull rope in the vicinity of this aperture are knots, or secured spheres, for dampening the movement of said pull rope through said aperture. Like Miller's disclosure, the dampening of the up and down movement of the skier-down flag may be useful for the boat operator, after he has learned to decipher the difference between a temporary slackening of the tow-rope and a tow-rope that has been released by the skier. However, one using this device cannot safely assume that the operators of neighboring boats understand the flag's signal until all tension has been taken off the rope, which usually occurs only when the boat has stopped to pick-up the downed skier, after a period in which said skier has had to fend for himself against nearby boat operators who remain unaware of a downed-skier situation.

Another problem with the downed water skier warning devices of Penaflor and Lodisio is in the enclosure of the flag within a hollow cylinder. Both disclosures teach placing the flag into said cylinder against a spring-like force for biasing the flag in an upward and outward direction. Said outward biasing renders an appearance of (if not an actual) danger to someone who might unsuspectingly place his head above and near the upward opening of said cylinder.

The disclosure of Langford teaches a more complex downed water skier warning device which uses an electric load cell attached to the tow-rope for detecting a released-rope situation and actuating an audible and visual indicator to the boat operator when such situation has occurred. Among the problems inherent in this particular device is that it depends upon the operator and/or another individual for raising the skier-down warning flag. As well, the problem of storing the skier-down flag in a place that allows for convenient access to the flag when the skier goes down, is not addressed by this disclosure. Both of these problems tend to decrease the use of the skier-down flag. Although said skier-down flag may be placed in its disclosed mounting structure after the operator of the tow-boat has turned the boat around, stopped to pick-up the downed skier and located the skier-down flag, this does not help to reduce the tremendous risks associated with the time interval during which other boaters are not alerted to the skier's fall.

Another problem inherent in all the tension-switch activated downed water skier warning devices of the prior art is that of not allowing a tow-boat operator to detect the dangerous situation that exists when his skier has fallen without releasing the tow-rope. This is a common occurrence among new skiers. In this circumstance, the skier flounders helplessly in the wake of the tow-boat in a posture which is also hard to detect by other boaters. Until the skier actually releases the skier rope handle, the tension-switch actuated warning devices of the prior art cannot accurately detect and/or signal a warning to the tow-boat diver or other boat operators that a problem exits. Another problem associated with the tension-switch actuated downed skier warning devices of the prior art is the inability of the tow-boat operator or other individual in the boat to override the warning device and raise the skier-down flag on his own at such times other than the occurrence of a significant decrease in tow-rope tension when he may deem it necessary.

While the downed water skier warning devices so disclosed in the prior art may be suitable for a particular purpose to which they address, it will be apparent to those skilled in the art that said devices would not be as suitable for the purposes of the present invention. With the exception of the skier-down flag itself, such prior art systems have also enjoyed little or no commercial acceptance for various reasons, including those described above.

SUMMARY OF THE INVENTION

In view of the foregoing disadvantages inherent in the known types of downed water skier warning devices now present in the art, the invention disclosed herein provides an improved downed water skier warning apparatus and system for warning the operator of a skier tow-boat and the operators of nearby boats when a skier releases the rope-handle of the skier tow-rope or falls into the water, said system including means for sensing when the rope-handle is released by the skier or otherwise is submerged in water, and means for indicating to the boat operator and for warning operators of nearby boats when this occurs. As such, the general purpose of the present invention, which is described in greater detail below, is to provide a new and improved downed water skier warning apparatus and system. To attain this, representative embodiments of the concepts of the present invention are illustrated in the appended drawings.

The objective of the drawings and the corresponding detailed description herein, is to illustrate various embodiments of the present invention, all of which make use of a remote sensing device affixed near or within a skier rope-handle of a water skier tow-rope for accurately sensing when a skier has either released the rope-handle or has otherwise fallen into the water. Also included in each of the various embodiments of the present invention is means for sending a signal responsive to the release of said rope-handle by the skier or the landing of said rope-handle in the water, said signal being for actuating various operator alarm indicators and warning indicators for operators of nearby boats.

It is therefore an object of the present invention to provide a new and improved downed water skier warning apparatus and system which has all the advantages of the prior art and none of the disadvantages.

It is a further object of the present invention to provide a new and improved downed water skier warning apparatus and system for automatically warning the operator of a skier tow-boat when a skier he is towing releases the tow-rope.

It is a further object of the present invention to provide a new and improved domed water skier warning apparatus and system for automatically warning the operator of a skier tow-boat when the skier rope-handle of a skier tow-rope he is pulling falls into the water.

It is a further object of the present invention to provide a new and improved downed water skier warning apparatus and system for automatically warning other boat operators in the vicinity of a downed skier when a skier releases the skier tow-rope.

It is a further object of the present invention to provide a new and improved downed water skier warning apparatus and system for automatically warning other boat operators in the vicinity of a downed skier when the skier rope-handle of a skier tow-rope falls into the water.

It is a further object of the present invention to provide a new and improved downed water skier warning apparatus and system which is adapted to be mounted on a boat without either substantially harming or defacing the boat or violating its structural integrity.

It is yet a further object of the present invention to provide a new and improved downed water skier warning apparatus and system which includes a skier-down flag- mount, said flag-mount being adopted for maintaining the skier-down flag in an unexposed down position while a water skier is being towed, and for automatically raising said flag to an up position visible to nearby boaters when said skier falls or otherwise releases the rope handle, said flag mount further being adapted for avoiding false signals created by various occurrences of temporary slack in the tow-rope.

It is yet a further object of the present invention to provide a new and improved downed water skier warning apparatus and system which includes a skier-down flag-mount for raising or lowering the skier-down flag responsive to the remote control of the tow-boat operator.

It is still a further object of the present invention to provide a new and improved downed water skier warning apparatus and system which includes a flag-mount with means for quickly removing a skier-down flag retained in said mount at such times as an operator of a skier tow-boat may deem said removal necessary.

It is another object of the present invention to provide a new and improved downed water skier warning apparatus and system which may be easily and efficiently manufactured, marketed and installed.

It is still a further object of the present invention to provide a new and improved downed water skier warning apparatus and system which is of durable and reliable construction.

It is yet still a further object of the present invention to provide a new and improved downed water skier warning apparatus and system which meet all federal, state, local and other private standards, guidelines, regulations and recommendations with respect to safety, environmental friendliness, energy conservation, etc.

An even further object of the present invention is to provide a new and improved downed water skier warning apparatus and system which is susceptible of a low cost of manufacture with regard to both materials and labor, and which accordingly is then susceptible of low prices of sale to the consuming public, thereby making such a downed water skier warning apparatus and system economically available to the buying public.

These together with other objects of the invention, along with the various features of novelty which characterize the downed water skier warning apparatus and system of the present invention, are pointed out with particularity in the claims appended hereto and forming a part of this disclosure. The more important objects of the present invention have been outlined rather broadly in order that the detailed description thereof which follows may be better understood, and in order that the present contribution to the art may be better appreciated. For a better understanding of the invention, its operational advantages and the specific objects attained by its uses, reference should be made to the accompanying drawings and descriptive matter in which there are illustrated various embodiments of the invention. Those skilled in the art will readily ascertain, however, that the invention is capable of other embodiments and of being practiced and carried out in various ways. In this respect, the details of construction disclosed herein, and the arrangements of the components set forth in the following description and appended drawings are for illustrative purposes, only, and are not intended to be limiting in scope. Those skilled in the art will appreciate, as well, that the conception upon which this disclosure is based, may readily be utilized as a basis for the designing of other structures, methods and systems for carrying out the several purposes of the present invention. Said other structures may include, but not be limited to, those which are aesthetic in nature, or those which include the substitution of other materials as they become available, and which substantially perform the same function in substantially the same manner with substantially the same result as the present invention. It is important, therefore, that the claims appended hereto be regarded as including such equivalent structures, constructions, methods and systems insofar as these do not depart from the spirit and scope of the present invention.

BRIEF DESCRIPTION OF THE DRAWINGS

The invention will be better understood and objects other than those set forth above will become apparent when consideration is given to the following detailed description. Such description makes reference to the appended drawings, wherein.

DETAILED DESCRIPTION OF VARIOUS EMBODIMENTS

The present invention comprises an improved downed water skier warning apparatus and system for warning the operator of a skier tow-boat and the operators of nearby boats when a water skier has released the skier tow-rope or has fallen into the water, such events comprising a "downed skier" situation. The apparatus and system of the present invention includes means for sensing when the water skier has fallen into the water or when the tow-rope has otherwise been released by the skier, and means for indicating to the tow-boat operator and operators of nearby boats when said "downed skier" situation occurs. Listed below are the major components which may be provided in various embodiments of the downed skier warning system of the present invention.

1) A remote alarm actuator is provided including an alarm actuator circuit comprising a transmitter circuit for transmitting a signal, and a water sensing circuit electrically connected to said transmitter circuit for disabling the transmitter circuit when the remote alarm actuator is submerged in water. Further provided in certain embodiments of the alarm actuator is a hand-pressure sensing circuit electrically connected to the transmitter circuit and affixed in the rope-handle of the skier tow-rope for similarly disabling said transmitter circuit when said hand-pressure sensing circuit detects the skier releasing the rope-handle.
2) Further provided is an operator alarm unit including an operator alarm circuit comprising a receiver circuit for receiving said signal from the remote alarm actuator, and a switching circuit responsive to said receiver circuit for actuating various operator alarm indicators and various warning indicators for being seen by operators of nearby boats.

Various embodiments of the invention are illustrated in the appended drawings and described in greater detail, below. (All like numerical designations in the figures represent the same element.)

Figures 1, 2, 8:
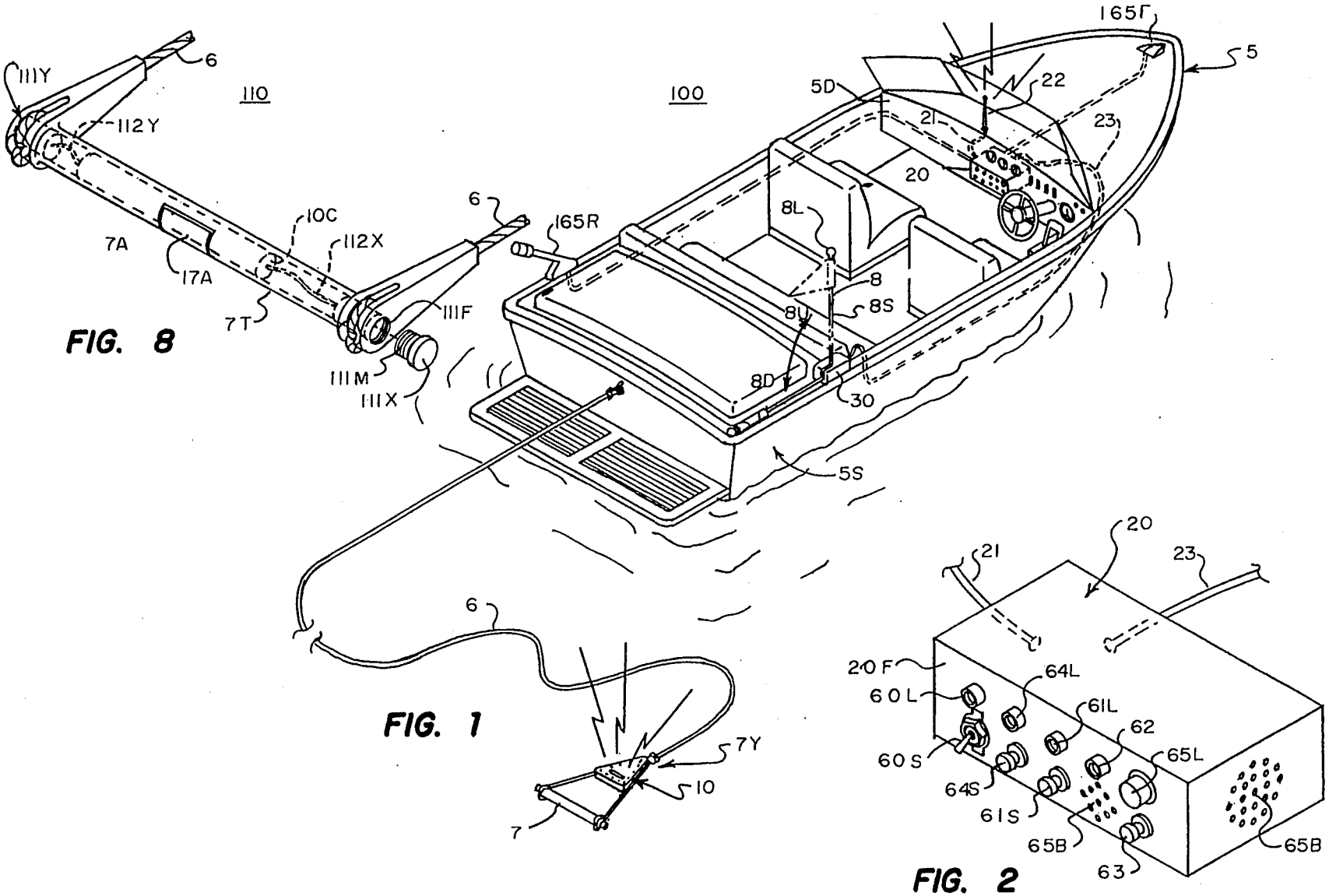
FIG. 1 is a perspective view of a typical water skiing apparatus which includes an embodiment of the various features of the downed water skier warning system of the present invention.
FIG. 2 is a perspective view of an embodiment of a combined tow-boat operator alarm and skier-down flag control box of the present invention.
FIG. 8 is perspective view of an alternate embodiment of a remote alarm actuator of the present invention, formed as part of a skier rope-handle.

FIG. 1 is a perspective view of an embodiment of a system 100 of the present invention for use with a water skier tow-boat 5. Said system 100 comprises means for sensing when a rope-handle 7 of the tow-rope 6 is submerged in water, means for indicating to the tow-boat operator when said rope-handle 7 is submerged and means for warning operators of nearby boats when said rope-handle 7 is submerged, said means for indicating and means for warning being responsive to said means for sensing. Said means for sensing includes a remote alarm actuator 10 affixed to the skier tow-rope 6 substantially adjacent to the skier rope-handle 7. Said means for indicating includes a tow-boat operator alarm unit 20 mounted in a dash-board 5D of the skier tow-boat 5 in view of the tow-boat operator (not shown). Electrically connected to the operator alarm unit 20 and mounted on the dash-board 5D of the skier tow-boat 5 is an alarm unit antenna 22 for receiving signals transmitted from the alarm actuator 10. Said means for warning includes a flag-mount 30 for mounting a skier-down flag 8 on the tow-boat 5. Further included in said means for warning is a rear warning light 165R and a front warning light 165F. Said flag-mount 30 is affixed to a deck or the like of said tow-boat 5 near a stern 5S, and includes means for raising and lowering a flagstaff 8S (on which said skier-down flag 8 is attached) between a first down position 8D in which the skier-down flag 8 is substantially juxtaposed and parallel to said deck or the like, and a second up position 8U in which the flagstaff 8S is substantially in an upright position and transverse the axis of the tow-boat. In the up position 8U, the flag end of the flagstaff 8S is substantially at a maximum distance above said deck or the like for affording the flag 8 maximum visibility for warning other boaters of a downed skier. Said rear warning light 165R is affixed near the stern of the tow-boat 5, and said front warning light 165F is affixed near the bow of the tow-boat 5 for automatically flashing as a warning to nearby boats when said skier releases the rope-handle 7 or falls into the water. Said flag-mount 30 and warning lights 165R and 165F are further electrically connected to the operator alarm unit 20, for being responsive to electric signals from said alarm unit 20. Those skilled in the art will recognize that locations on the boat 5 for affixing the various elements of the system 100 may vary significantly without changing the scope of the present invention. The key location requirements for elements of the system 100 are the placement of the remote alarm actuator 10 (near the skier tow handle), the placement of the operator alarm unit 20 (in sight and/or hearing range of the tow-boat operator while he is operating the tow-boat), and the skier-down flag 8 and flag-mount 30 and warning lights 165R and 165F (where the skier-down flag 8 and warning lights 165R and 165F can be readily seen by nearby boaters when the skier-down flag is in the up position 8U and/or the warning lights 165R and 165F are actuated). Those skilled in the art will also recognize that locating the skier-down flag 8 and the flag-mount 30 near the tow-boat operator can provide greater convenience to said operator, as well as provide for a back-up operator alarm should the tow-boat operator fail to see or hear the operator alarm unit 20 or the warning light 165F. For this reason, some may choose to combine the flag-mount 30 with the operator alarm unit 20 in the same integral unit, and affix same to the tow-boat 5 in a position from which said integral unit can be readily observed by the tow-boat operator while he is maneuvering said tow-boat 5. Those familiar with the art will also recognize that the warning lights 165R and 165F can be made as part of the red and green bow light and the white stern light common on many boats.

FIG. 2 illustrates an embodiment of the exterior of the operator alarm unit 20. In this embodiment, the operator alarm unit 20 is electrically connected to the alarm unit antenna 22 via a conductor or wire 21, and further connected electrically to the flag-mount 30 via a conductor or a wire 23. It is preferred that the operator alarm unit 20 be mounted in the tow-boat 5 such that a face 20F of the alarm unit 20 is visible to the tow-boat operator when he is driving boat 5. This is accomplished as illustrated in FIG. 1 via placement of said alarm unit 20 under and behind the dash-board 5D such that a face 20F of the alarm unit 20 is coplanar with the other instrumentation on the dash-board 5D. However, those skilled in the art will recognize that other locations in the tow-boat 5 are available which may be just as effective for mounting said operator alarm unit 20 such that the face 20F is in view of the tow-boat operator. On the face 20F are various switches for controlling the system 100, and various alarm unit indicators for indicating the operation of various system functions and for warning the tow-boat operator when a skier he is towing has either fallen or has released the rope-handle 7. Said switches and indicators may include, but are not limited to, those described below.

- A unit power ON-OFF switch 60S is provided for controlling the electrical power for enabling the operator alarm unit 20, the flag-mount 30, the warning lights 165R and 165F and the alarm unit antenna 22.
- A power-ON indicator 60L is provided for indicating to the tow-boat operator when the power ON-OFF switch 60S is closed and power for operating the unit is being supplied so that said operator alarm unit 20 is turned-"N".
- A system diagnostic test switch 64S is provided for initiating a system diagnostic test paradigm.
- A system diagnostic test-running indicator 64L is provided for indicating when the system diagnostic test paradigm is operating.
- A mute switch 61S is provided for allowing the tow-boat operator to deactivate a skier-down audible alarm 65B, which may include one or more loud speakers or buzzers mounted to the interior surface of a side of the operator alarm unit 20 for giving an audible warning to the tow-boat operator when the skier has either fallen or has released the rope-handle 7.
- A mute indicator 61L is provided for indicating to the tow-boat operator when the skier-down audible alarm 65B has been deactivated.
- A skier-down visual alarm 65L is provided for warning the tow-boat operator when the skier has either fallen or has released the rope-handle 7. Said visual alarm 65L of the present embodiment is illustrated as being a light which is larger than any other of the visual indicators of the operator alarm unit 20, for being more easily distinguished from the other visual indicators. Although this is a preferred form of the visual alarm 65L of the present invention, those skilled in the art will recognize that a wide variety of shapes, sizes and configurations of the visual alarm 65L can be utilized and remain within the spirit and scope of the present invention. As well, the operator alarm unit 20 may not include said visual alarm 65L, but rather utilize solely the front warning light 165F or the skier-down flag 8 mounted within the operating vision of the tow-boat operator as the visual operator alarm, in order to decrease the size of said alarm unit 20.

A skier-down audible alarm 65B is provided for audibly warning the tow-boat operator when the skier has either fallen or has released the rope-handle 7. Said audible alarm 65B of the present embodiment is a small speaker affixed to the underside of the control box face 20F for emitting a monotonic sound when said downed-skier situation occurs.

A system reset switch 63 is provided for use by the tow-boat operator to reset the system 100 at such times as when a unit test has been performed or a downed skier has been retrieved.

A transmissions-ON indicator 62 is provided for indicating when transmissions from the remote alarm actuator 10 are, or are not, being received.

The embodiment of the operator alarm unit 20 illustrated in FIG. 2 includes two types of switches (a toggle switch and a plurality of push-button switches), and two types of visual indicators (a plurality of LED's and a larger light). Those skilled in the art will recognize that the true spirit and scope of the present invention is not limited to these particular types of elements, but that a wide variety of switches and visual indicator means are available for use in the operator alarm unit 20 which can perform substantially the same function as the elements illustrated herein.

Figure 3:
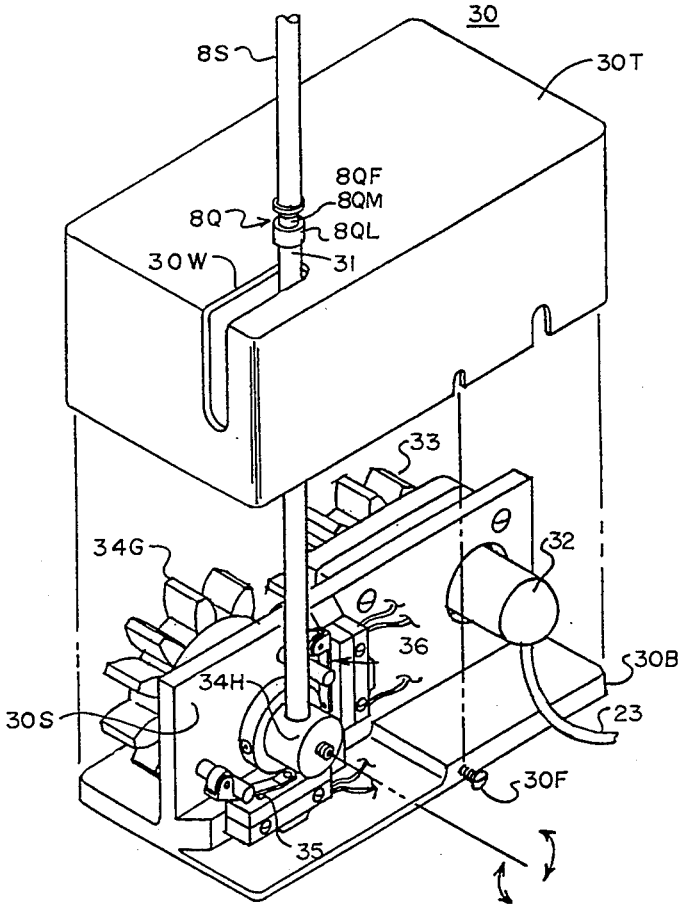
FIG. 3 is a perspective view of an embodiment of a skier-down flag-mount of the present invention with a top cover raised for viewing the internal mechanism.

In FIG. 3 is illustrated an embodiment of the flag-mount 30 of the present invention, which comprises a top cover 30T releasibly mounted on a base 30B having threaded fasteners 30F and adjoining apertures (not shown) for releasibly locking the top cover 30T onto said base 30B, a fixed stem 31 for holding a flagstaff 8S of the skier-down flag 8, and a quick-release latch 8Q for removably connecting the flagstaff 8S to the fixed stem 31. Said quick-release latch 8Q is of the type having a male end 8QM with a spring biased latch cover 8QL for connectably receiving a female end 8QF. The quick-release latch 8Q allows a boat operator or other individual to release the skier-down flag 8 from the flag-mount 30 for use away from said flag-mount 30 when such use is deemed appropriate. The fixed stem 31 extends through a top cover window 30W from a center hub 34H of a switching gear 34G to which it is affixed for angular movement about an arc of the circumference of the hub 34H, between said up and down positions 8U and 8D (FIG. 1) respectively. The switching gear 34G is interlockingly connected to a driving gear 33 of an electric motor 32, for moving said center hub 34H. Said switching gear 34G, driving gear 33 and electric motor 32 are affixed to a supporting fixture 30S of the base 30B. The electric motor 32 is further connected electrically to the operator alarm unit 20 via the wire 23. When the fixed stem 31 is moved between said down and up positions 8D and 8U, it is removed from physical contact with one, and placed into physical contact with the other, of a pair of spring-leaf limit switches 35 and 36, respectively, which are each affixed to said supporting fixture 30S substantially adjacent to the down or up position 8D or 8U with which each is associated, for moving said limit switches 35 and 36 between an open circuit and a closed circuit position. Said limit switches 35 and 36 are spring biased toward the open circuit position. When one of the limit switches 35 or 36 is moved by the fixed stem 31 from said open- to said closed-circuit position, the electric motor 32 is disabled and said angular movement of the fixed stem 31 is thereby stopped.

An alternate version of the flag 8 and flag-mount 30 includes a flag-light 8L (FIG. 1) affixed above the flag 8 on the flagstaff 8S for automatically lighting as a warning to nearby boaters when the flag 8 is in the up position 8U. It is preferred that the flag-light 8L be of the type that flashes when actuated, for being more readily noticed by nearby boat operators. Use of the flag-light 8L can significantly increase the ability of nearby boaters to identify the skier down flag 8. The flag-light 8L is electrically connected to the flag-mount 30 and/or the operator alarm unit 20 via a conductive path such as a wire affixed along the lengths of the flagstaff 8S and the fixed stem 8F and further releasibly connected at the quick release latch SQ. Those skilled in the art will know of various types of flashing lights which may be suitable for this element of the present invention, including strobe lights, rotating beacons or the like.

Figure 4:
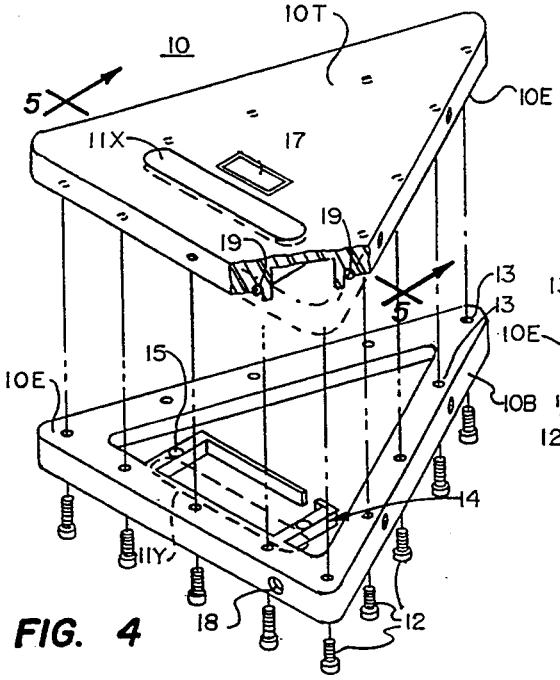
FIG. 4 is an exploded perspective view with partial cut-away of an embodiment of a remote alarm actuator (minus electrical circuitry) of the present invention.
Figure 5:
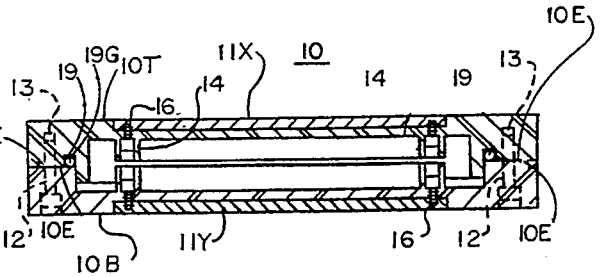
FIG. 5 is a sectional view of the remote alarm actuator of FIG. 4.
Figure 6:
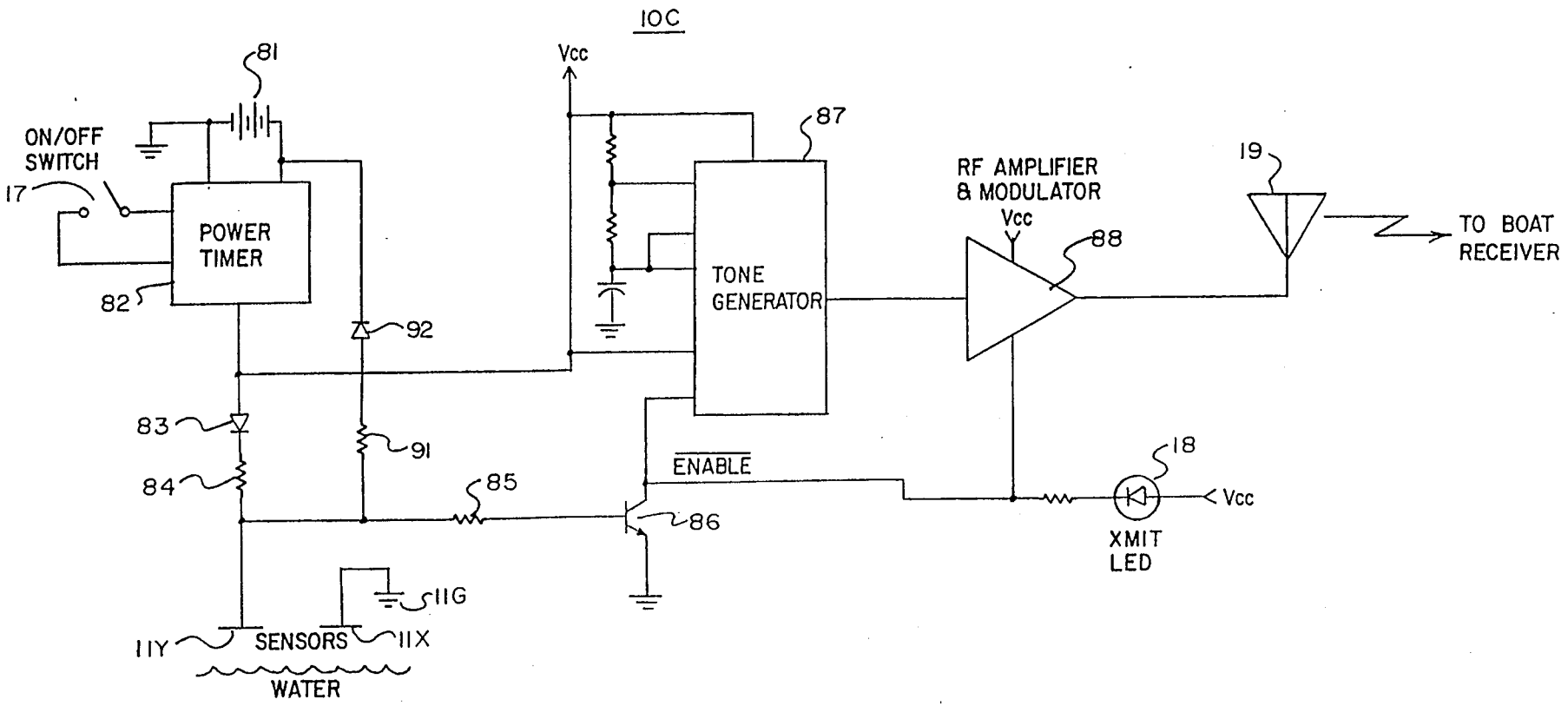
FIG. 6 is an electronic schematic of an embodiment of a remote alarm actuator circuit of the present invention.

FIGS. 4 and 5 illustrate an embodiment of the remote alarm actuator 10 of the present invention, minus the necessary electrical circuitry (illustrated in FIG. 6). Said alarm actuator 10 is self contained, having space adequate for housing an appropriate power source, such as a nine volt dry cell battery, and formed in a triangular shape for readily mounting the actuator 10 in a handle yoke 7Y of the tow-rope 6 (FIG. 1 ), which is an element common to most water skiing tow-ropes for securing the rope-handle 7 to said tow-rope 6. As further illustrated in FIGS. 4 and 5, the alarm actuator 10 includes a top container portion 10T and a bottom container portion 10B for enclosing an alarm actuator circuit 10C (FIG. 6) of the alarm actuator 10. Said top and bottom container portions 10T and 10B are joined along peripheral edges 10E via a plurality of threaded male type fasteners 12 which are connectably received by a plurality of correspondingly threaded female type apertures 13. It is preferred that said top and bottom container portions 10T and 10B are connected via a water-resistant sealing means, such as a flexible rubber type gasket placed between the peripheral edges 10E (not shown). As well, the circuit 10C may be placed in a water resistant shrink wrap covering or a durable water resistant coating which is applied via a dipping process, such as that which is common in marine and U.S. military electronic equipment for inhibiting corrosion.

An antenna 19 is affixed within the alarm actuator 10 inside an antenna conduit 19G which is formed between the top and bottom container portions 10T and 10B adjacent the interior radius of the peripheral edges 10E. On the exterior surfaces of the container portions 10T and 10B is affixed a pair of water sensor plates 11X and 11Y, respectively, for sensing when the actuator 10 lands in water, and for simultaneously disabling a transmitter circuit of the alarm actuator 10, which is described in greater detail, below. Said sensor plates 11X and 11Y may also be used to recharge a power source (not shown) used in the alarm actuator 10, as is described in greater detail, below. The sensor plates 11X and 11Y of this embodiment are affixed to said container portions via male threaded fasteners 16 which are seated in correspondingly threaded apertures 15 of a retaining structure 14, which is affixed inside each of the container portions 10T and 10B within the circumference of the peripheral edges 10E. A push-button type, water resistant membrane covered power ON-OFF switch 17 is provided for enabling the alarm actuator 10. A system-ON visual indicator 18, such as a flashing LED, is also further provided for use by the skier as a reference indicating that the alarm actuator 20 is operating.

Various modes of operating the system 100 of the present invention are available, and include those described below. The operator alarm unit 20 may be enabled by placing the power ON-OFF switch 60S into the ON position. This actuates the power ON-OFF indicator 60L. If the fixed stem 31 is in the down position 8D, it remains in said down position 8D. If the fixed stem 31 is in the up position 8U, it may be placed in the down position 8D via one of the following two methods: by actuating the diagnostic test switch 64S or by actuating the reset switch 63. Upon actuation of the diagnostic test switch 64S, the diagnostic test-running indicator 64L is turned ON, followed by the sequential temporary actuation of all the system visual and audible indicators, to include the lowering of the fixed stem 31. Should the fixed stem 31 already be in the down position 8D when said test switch 64S is actuated, it will be raised to the up position 8U and then automatically lowered to the down position 8D. The fixed stem 31 may also be lowered via actuation of the reset switch 63. When the reset switch 63 is actuated subsequent to a system actuation of the operator alarm unit 20, the fixed stem 31 is automatically lowered, and the skier-down visual and audible alarms are deactuated. The tow-boat operator may choose to disable the audible operator skier-down alarm 65B via actuating the mute switch 61S, which will likewise actuate the mute switch indicator 61I, for reminding the operator that said mute switch 61 S has been actuated.

Upon actuation of the power ON-OFF switch 17 of the alarm actuator 10, said alarm actuator 10 begins transmitting an encoded signal to the operator alarm unit 20. While said signal is being transmitted within a communicable range of the alarm unit 20, the transmissions-ON indicator 62 of the alarm unit 20 is activated. Should the signal of the alarm actuator 10 be stopped, such as happens when said alarm actuator 10 enters the water, the transmissions-ON indicator 62 of the operator alarm unit 20 will be deactivated simultaneously with the actuation of the operator skier-down alarms 65L and 65B, the raising of the skier down flag 8, the flashing of the flag-light 8L, and the flashing of the front and rear warning lights 165F and 165R. Of course, the audible skier-down alarm 65B will not be so actuated when the mute indicator 61L is ON.

Figure 7:
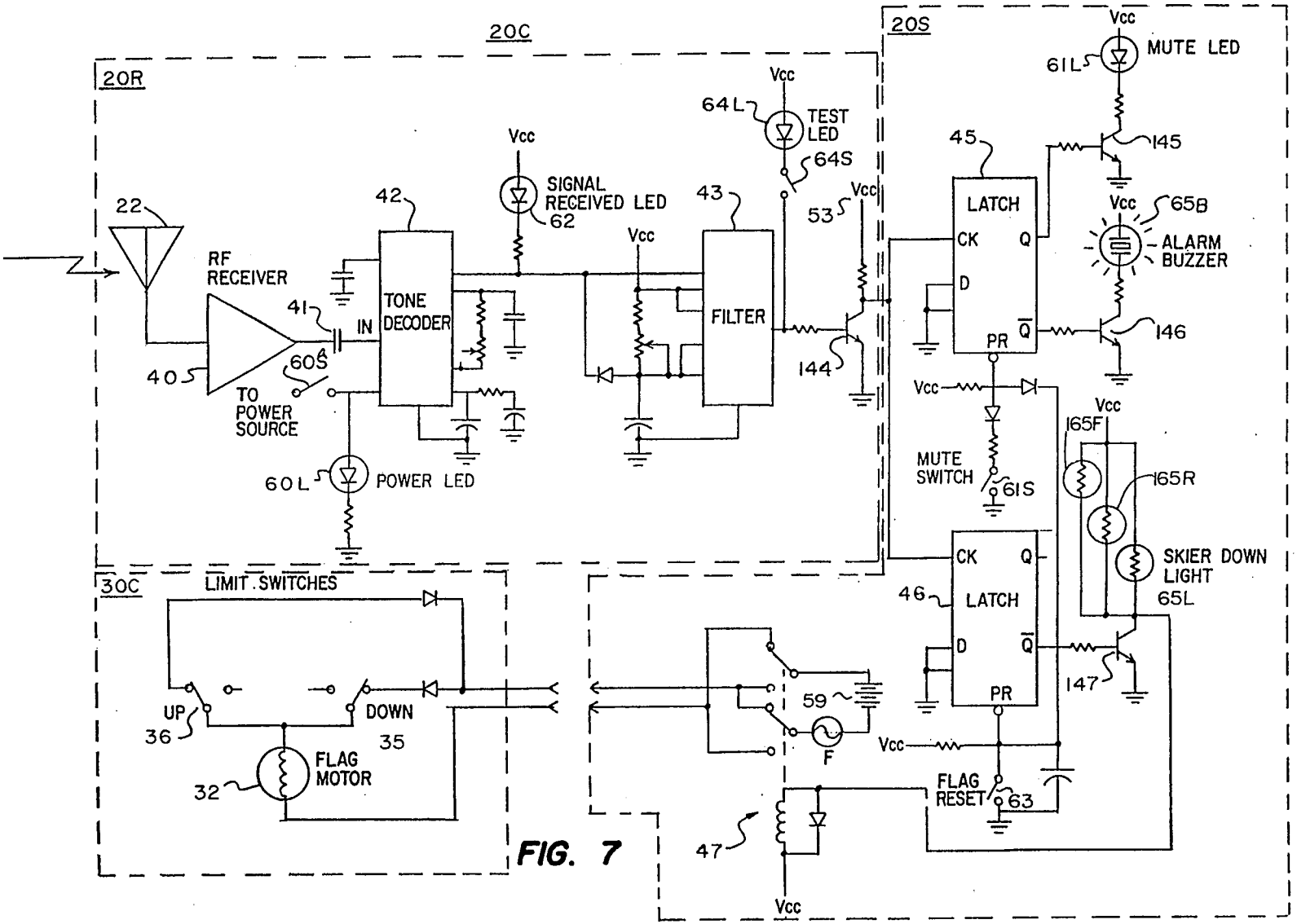
FIG. 7 is an electronic schematic of an embodiment of a tow-boat operator alarm circuit of the present invention.

FIGS. 6 and 7 illustrate an electronic schematic of an embodiment of an alarm actuator circuit 10C of the alarm actuator 10, an operator alarm circuit 20C of the operator alarm unit 20 and a flag-mount circuit 30C of the flag-mount 30. The actuator circuit 10C of the alarm actuator 10 includes a transmitter circuit 10X for transmitting a signal, and a water sensing circuit 10W electrically connected to said transmitter circuit 10X for disabling the transmitter circuit 10X when said water sensing circuit 10W is submerged in water. The transmitter circuit 10X comprises a power ON-OFF switch 17 for applying a voltage potential between the alarm actuator 10 and a suitable power source 81, such as a 9 volt battery. The switch 17 is electrically connected to a timer 82 for disabling the alarm actuator 10 after a predetermined amount of time has elapsed since said switch 17 was last actuated, and during which said timer was not otherwise reset. This is for preventing an unplanned draining of the power source 81 via an accidental actuation of said switch 17 or another form of system short. The remaining elements of the transmitter circuit 10X are a tone generator/encoder 87, an RF amplifier/-modulator 88 and an antenna 19: all of which are common elements of transmitter circuits that are well known in the art. Those skilled in the art will further recognize that various other forms of switches and timing circuits are available for performing substantially the same function as switch 17 and timer 82 of the present embodiment, within the scope of the present invention.

Figure 9:
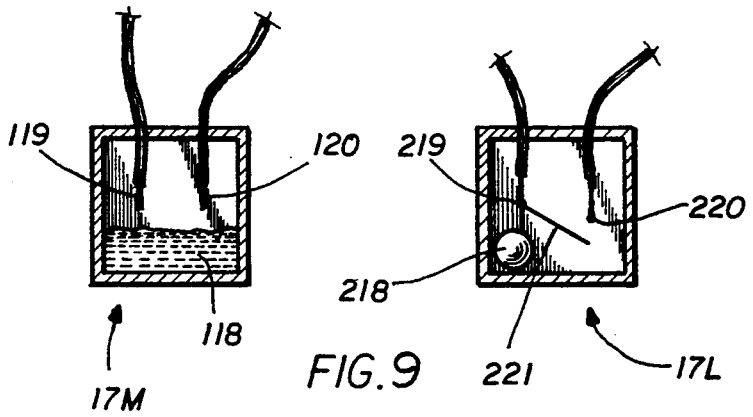
FIG. 9 is a side plan view with a cut out side of a pair of motion detector switches, for use with various embodiments of the remote alarm actuator of the present invention.

An example of such other type of switch which may be used in the present embodiment of the alarm actuator circuit 10C is a motion detector switch, such as a mercury switch 17M or a leaf-spring switch 17L affixed within said alarm actuator 10 and depicted in FIG. 9, for use in resetting the timer and thereby re-enabling the alarm actuator 10 when said alarm actuator is moved. In the mercury switch 17M is provided an amount of mercury 118 for establishing a current between a pair of electrodes 119 and 120 which are for use in the circuit 10C in lieu of the switch 17, when said mercury 118 is moved into contact with said pair of electrodes 119 and 120. In the leaf spring switch is a weight 218 which closes a circuit across a pair of electrodes 219 and 220 when it pushes a leaf spring 221 into contact with said pair of electrodes. Said motion detector switches may be used in lieu of the manually operated switch 17, placed in parallel relationship with said switch 17 as a "back-up" switch to said switch 17, or placed in linear relationship to said switch 17, thereby allowing said switch 17 to turn-OFF access to the power source completely for saving electrical energy when said alarm actuator is in storage.

In the embodiment of said alarm actuator circuit 10C (FIG. 6), power is applied across a diode 83 and resisters 84 and 85 to turn on a transistor 86 for moving the collector of transistor 86 to ground potential when the switch 17 is actuated and the alarm actuator 10 is not in the water. Actuating the switch 17 further actuates the system-ON visual indicator 18 and the tone generator-/encoder 87 with the amplifier/modulator 88 for transmitting a preselected tone through the antenna 19. Further provided in the circuit 10C is the pair of water sensor plates 11Y and 11X which are electrically connected between a power source 81 and the transmitter circuit 10X for disabling said transmitter circuit 10X. When said water sensor plates 11X and 11Y are submerged in water, a conductive path is established between a ground 11G and the power source 81 across said sensor plates 11Y and 11X, a resister 91 and a diode 92. This simultaneously resets the timer 82 and disables the remainder of the transmitter circuit 10X from transmitting a signal via the antenna 19. The simultaneous disabling of the tone generator/encoder 87 and the amplifier/modulator 88 of the circuit 10C provides for a double safety in the alarm actuator 10, by not allowing either of these elements to transmit a signal through antenna 19 when said alarm actuator 10 is in the water. When the sensor plates 11Y and 11X are taken out of the water, the electric connection there-between is eliminated, thereby re-enabling the transmitter circuit 10X of the alarm actuator 10 and resetting the timer 82.

A secondary function of the sensor plates 11Y and 11X of this embodiment of the alarm actuator 10 is for use as conductor plates between the power source 81 and a recharging element (not shown) for recharging the power source 81 across a recharging circuit comprising resister 91 and diode 92. Suitable timers for the timer 82 and tone generator/encoder 87 of the present embodiment are LM555 timers from National Semiconductor Corporation, although those skilled in the art will recognize that other delay- and/or oscillating-timers may be utilized within the spirit and scope of the present invention. The timer 82 of the present embodiment is set in a one-pulse configuration for disabling the alarm actuator 10 after a preselected time. The timer of the tone generator/encoder 87 of the present embodiment is set in a high speed oscillating and self-resetting configuration, with recommended frequencies between 500 hertz and 10 mega-hertz. The alarm actuator circuit 10C of this embodiment is simple, effective and economical. However, those skilled in the art will know of methods other than the use of a timing-circuit/tone-generator in combination with an amplifier/modulator for selectively transmitting a preselected code suitable for selectively receiving and decoding, which may work in substantially the same manner as the circuit 10C within the spirit and scope of the present invention.

Further provided in this embodiment of the system 100, is an operator alarm circuit 20C (FIG. 7) of the operator alarm unit 20, which includes a receiver circuit 20R for receiving a signal from the transmitter circuit 10X of the alarm actuator 10, and a switching circuit 20S responsive to said receiver circuit 20R for actuating various operator alarm indicators and various warning indicators for being seen by operators of nearby boats. The signal transmitted from the antenna 19 of the circuit 10C is received by the antenna 22 of the receiver circuit 20R of the operator alarm unit 20, which conducts said signal to a suitable receiver/amplifier 40. The amplified signal is then transmitted across a coupling capacitor 41 through a suitable tone decoder 42, such as an LM567 tone decoder from National Semiconductor Corporation, for validating that the received signals have the same characteristics of the preselected signal. Signals which are validated are then output across the transmissions-ON indicator 62 to a suitable low-pass filter 43 for filtering out minor erratic signals from the alarm actuator 10 and other system noise. The signal passes through the filter 43 to an npn transistor 144, in which a collector is actuated, thereby grounding said signal. When the water sensor plates 11Y and 11X of the alarm actuator 10 are placed in water, thereby disabling the transmitter circuit 10X, the transmissions-ON indicator 62 of the alarm unit 20 is deactivated and the validated signal crossing said filter 43 is stopped. The collector of the transistor 144 is thereby allowed to float, whereby the current from a voltage source 53 is allowed across the switching circuit 20S for actuating various alarm indicators of this embodiment of the present invention. Said switching circuit 20S includes a pair of suitable data latches 45 and 46, such as is provided by a pair of LM7474 dual flip-flop integrated circuits having "clear" and "reset" capabilities. When said current from the voltage source 53 is allowed across the switching circuit 20S, the data latches 45 and 46 "close" in relation to each of a plurality of npn transistors 145, 146 and 147 connected to said latches, for allowing a current across each of said transistors and at least one alarm indicator with which the collector of each transistor 145, 146, or 147 is connected, thereby actuating the audible and visual skier-down alarms 65B and 65L and the warning lights 165R and 165F. Like the flag-light 8L, it is preferred that said warning lights 165F and 165R be of the flashing type for being more readily noticed by nearby boaters. Should the flag-light 8L be connected to the alarm unit 20, it is preferred that it be connected in parallel with the visual skier-down alarm 65L and the warning lights 165R and 165F. As well, should the tow-boat operator have the mute switch 61 S actuated when said alarm actuator 10 is submerged in water, the mute switch indicator 61L will be actuated in lieu of the audible skier-down alarm 65B. Electric current is subsequently established across the latch relay 47 to the electric motor 32 of the flag-mount 30 for causing the skier-down flag 8 to move from the down position 8D to the up position 8U, and thereby come into contact with the limit switch 36 for opening the circuit 10C across the electric motor 32 for disabling said motor. With this embodiment of the present invention, the tow-boat operator is automatically alerted and a plurality of highly visible skier-down indicators are automatically displayed for warning nearby boaters when the rope-handle 7 and the adjacent alarm actuator 10 fall into the water, such as occurs when the water skier releases the rope-handle 7, or when the water skier falls into the water without releasing said rope-handle 7.

At any appropriate time after the operator alarm unit 20 and the various warning indicators of the downed water skier warning system of the present invention have been actuated, such as when the downed water skier is retrieved, the alarm unit 20 and the various warning indicators maybe readily deactivated via the reset switch 63. When said reset switch 63 is closed:, the data latches 45 and 46 are consequently reset, causing the data latches 45 and 46 to "open" in relation to each of the transistors 145, 146, and 147, thereby allowing each of the collectors of the transistors 145, 146 and 147 to float, for disabling the skier down light 65L, the warning lights 165R and 165F, the flag light 8L and the tow-boat operator skier-down alarms 65B and 65L (or said mute switch indicator 61L). Actuation of the reset switch also allows the latch relay 47 to reset, which establishes a conductor between a voltage source 59 and the electric motor 32. The flag 8 is thereby moved from the up position 8U to the down position 8D, at which the limit switch 35 is moved by the flagstaff 8S to the open circuit position, thereby disabling the conductive path between the voltage source 59 and the electric motor 32 for stopping said flag movement.

An alternate embodiment of the alarm actuator of the system 100 of the present invention is illustrated in FIG. 8. In this embodiment, an alarm actuator 110 comprises a rope-handle 7A, which further comprises a hollow tube 7T connected at each of two ends to the handle yoke 7Y (FIG. 1). Affixed inside the hollow tube 7T is the circuit 10C (FIG. 6) of the alarm actuator 110. It is preferred that the circuit 10C is enclosed in a water resistant casing such as shrink wrap, which is illustrated, and/or in a water resistant coating process as is the alarm actuator 10. Said circuit 10C is electrically connected to a pair of water sensor plates 111X and 111Y (represented as sensor plates 11X and 11Y in the circuit 10C of FIG. 6)which are affixed at either end of the hollow tube 7T such that said sensor plates 111X and 111Y will contact the water when the alarm actuator 7A is dropped or placed in said water. In the illustrated embodiment, the sensor plates 111X and 111Y each comprise an internally threaded female portion 111F which is affixed via a water tight seal into an end of the hollow tube 7T, and an externally threaded male portion 111M for releasibly seating in said female portion 111F. The removable seating of said male portion 111M allows for the convenient insertion and extraction of the circuit 10C for maintenance. It is preferred that a flexible rubber type gasket, or "O-ring", be secured about said male portion 111M of the sensor plates 11 1X and 111Y for creating a water resistant seal between said male and female portions 111F and 111M. Affixed to the hollow tube 7T is a push-button type, water resistant, membrane covered actuator power ON-OFF switch 17A for use by the water skier for enabling the alarm actuator 110. Said ON-OFF switch 17A is spring biased in the OFF position. Like the alarm actuator 10, the alarm actuator 110 may be provided with a motion detector switch in lieu of, or in combination with, said ON-OFF switch 17A.

Figure 10:
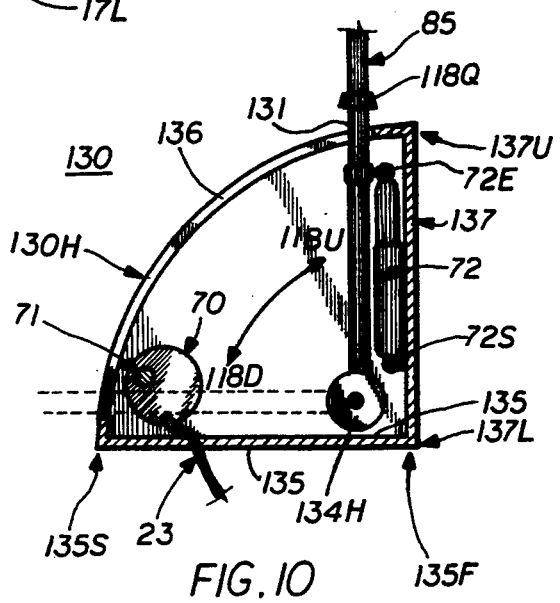
FIG. 10 is a front elevation view with cut-away side surfaces of another embodiment of a skier-down flag-mount of the present invention.
Figure 11:
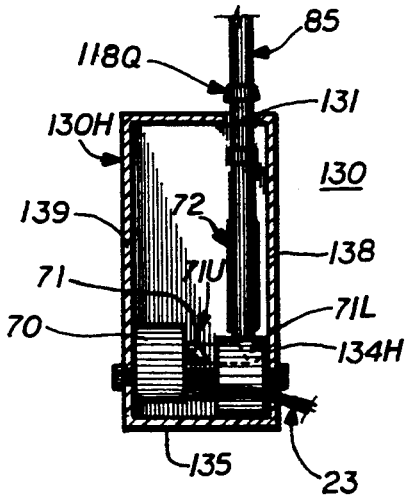
FIG. 11 is a side elevation view with cut-away side surfaces of the embodiment of FIG 10.

An alternate embodiment of the skier-down flag-mount of the present invention is illustrated in FIGS. 10 and 11. In this embodiment is provided a flag-mount 130 which similarly includes means for raising said skier-down flag 8 from a down position 118D to an up position 118U, similar to said up and down positions 8U and 8D of the embodiments illustrated in FIG. 1, said means for raising being responsive to said means for sensing of the alarm actuator of the present invention. However, the skier-down flag 8 mounted in the flag-mount 130 is lowered manually. Said flag-mount 130 further comprises a housing 130H having an elongate substantially rectangular base 135 for mounting to a deck, a substantially vertical abutment 137 which is substantially equivalent in dimension to said base 135 and further which is connected to a first end 135F of said base 135 at a lower end 137L of said abutment 137 at a substantially right angle, and a sloping top 136 connected at each end along adjoining edges between a second end 135S of the base 135 and an upper end 137U of the abutment 137, said sloping top 136 substantially subscribing a 90° arc about the connection between said first end 135F and said upper end 137U. The flag-mount 130 further comprises a fixed stem 131 to which the flag-stem 8S of the skier-down flag 8 is attached via a quick release latch 118Q. Said fixed stem 131 is pivotally connected between front and rear surfaces 138 and 139 of the housing 130H, respectively, and substantially adjacent the comer connection between said lower end 137L and said first end 135F, for movement between the up and down positions 118U and 118D, respectively. Pivotally affixed at an extending first end 72E to the fixed stem 131 at a point substantially adjacent to said sloping top 136, and pivotally affixed at a stationary second end 72S to the abutment 137 and above the hub 134H is a spring bias means 72, for biasing said fixed stem 131 in said up position 118U. It is preferred that said spring bias means 72 include means for dampening the movement of the fixed stem 131 between said down and up positions 118D and 118U, respectively. The spring bias means 72 illustrated in FIG. 10 is a fluid dampened enclosed spring, however those skilled in the art will recognize that other devices exist which are capable of accomplishing substantially the same function within the spirit and scope of the present invention. A further element of the housing 130 includes means for securing said fixed stem 13 1 in the down position 118D. Said means for securing illustrated in the embodiment of FIGS. 10 and 11 is a solenoid 70, which includes a movable locking pin 71. Said locking pin 71 is enabled for movement between a first unlocked position 71 U to a second locked position 71L via the transmission of electric current from the operator alarm unit 20 along an electrical conductor or wire 23.

When a skier using the embodiment of the skier-down flag-mount 130 of FIGS. 10 and 11 is being towed, the fixed stem 131 is manually lowered into said down position 118D and secured below the locking pin 71, which is extended in the lock position 71L. At actuation of the operator alarm 20, when the skier falls or the alarm actuator 10 is dropped into the water, an electric signal is sent from the operator alarm unit 20 to the solenoid for moving the locking pin 71 from the locked position 71L to the unlocked position 71U and thereby releasing the fixed stem 131 for automatically moving to said up position 118U. Said locking pin 71 is spring biased for automatically returning to the locking position 71L upon deactivation of the solenoid 70. Further provided with the locking pin 71 is a beveled end 71E for allowing said fixed stem 131 to be lowered past said locking pin 71, during which the locking pin 71 is pushed from the lock position 71L toward the unlock position 71 U by said fixed stem 131 and subsequently allowed to automatically return to said lock position 71L once the fixed stem 131 is past the locking pin 71.

FIGS. 13–20 illustrate various alternate embodiments of the downed water skier warning system of the present invention, in which are provided means for sensing when a water skier being towed by the tow-boat 5 releases the rope-handle 7, means for indicating to the tow-boat operator when said skier releases the rope-handle 7, and means for warning operators of nearby boats when said rope-handle 7 is released. Said means for indicating and means for warning in these various embodiments are substantially similar to the operator alarm unit 20 and the various operator alarm indicators and other warning indicators of the system 100, and are similarly responsive to said means for sensing. Said means for sensing includes a remote alarm actuator with an alarm actuator circuit which comprises a transmitter circuit for transmitting a signal, and a hand-pressure sensing circuit affixed in the rope-handle for disabling said transmitter circuit when said hand-pressure sensing circuit detects the skier releasing the rope-handle, said hand-pressure sensing circuit and said transmitter circuit being electrically connected.

Figure 12:
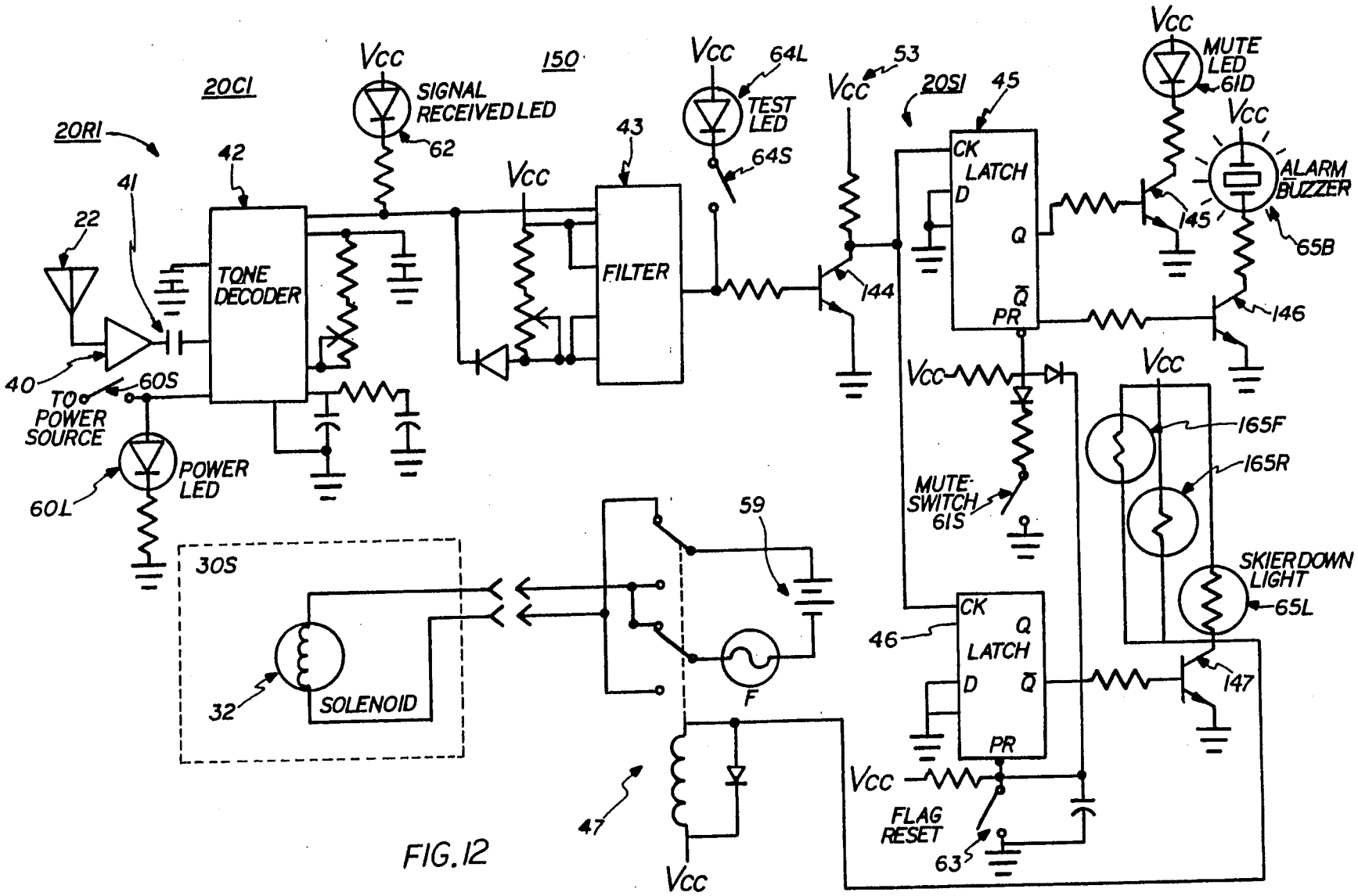
FIG. 12 is an electronic schematic of another embodiment of the tow-boat operator alarm- and skier-down flag-mount-circuits of the present invention.

Illustrated in FIG. 12 is an electronic schematic of the operator alarm unit 20 and flag mount 130 (FIGS. 10 and 11) of an embodiment of a system 150 of the present invention. In this embodiment of the circuitry of said system 150 is provided an operator alarm circuit 20C1 of the operator alarm unit 20, which includes a receiver circuit 20R1 for receiving a signal from the transmitter circuit 10X of the alarm actuator 10 (or 110); a switching circuit 20S1 for actuating various alarm indicators of the system 150 of the present invention; and a flag-mount 10 circuit 30S of the flag mount 130. Said circuits 20C1 and 30S are substantially similar to the circuits 20C and 30C of FIG. 7, with the solenoid 70 replacing the flag motor 32 and the limit switches 35 and 36. Actuation of the latch relay 47 enables the solenoid 70 for moving the locking pin 71 from said locked position 71L to said unlocked position 71U. When the reset switch 63 is closed, said latch relay 47 is reset to its open circuit position, and consequentially the solenoid 70 is deactuated, for allowing the locking pin 71 to automatically return to the locked position 71L.

Figure 13:
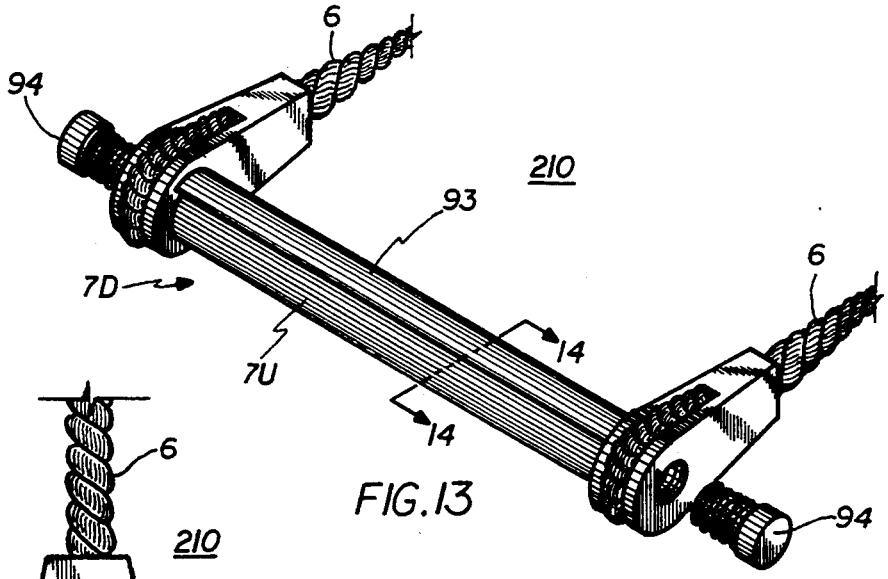
FIG. 13 is a perspective view of another embodiment of the remote alarm actuator of the present invention, formed as part of a water skier rope-handle.
Figure 14:
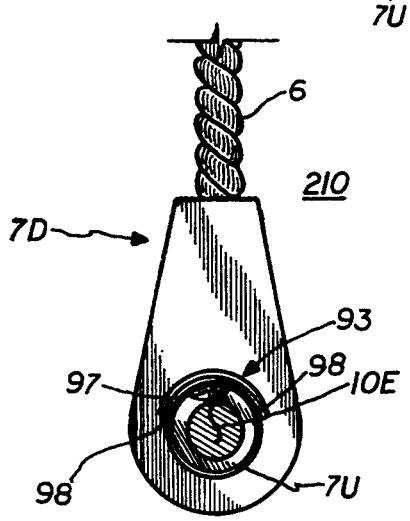
FIG. 14 is a side elevation sectional view of the embodiment of FIG. 13.
Figure 15:
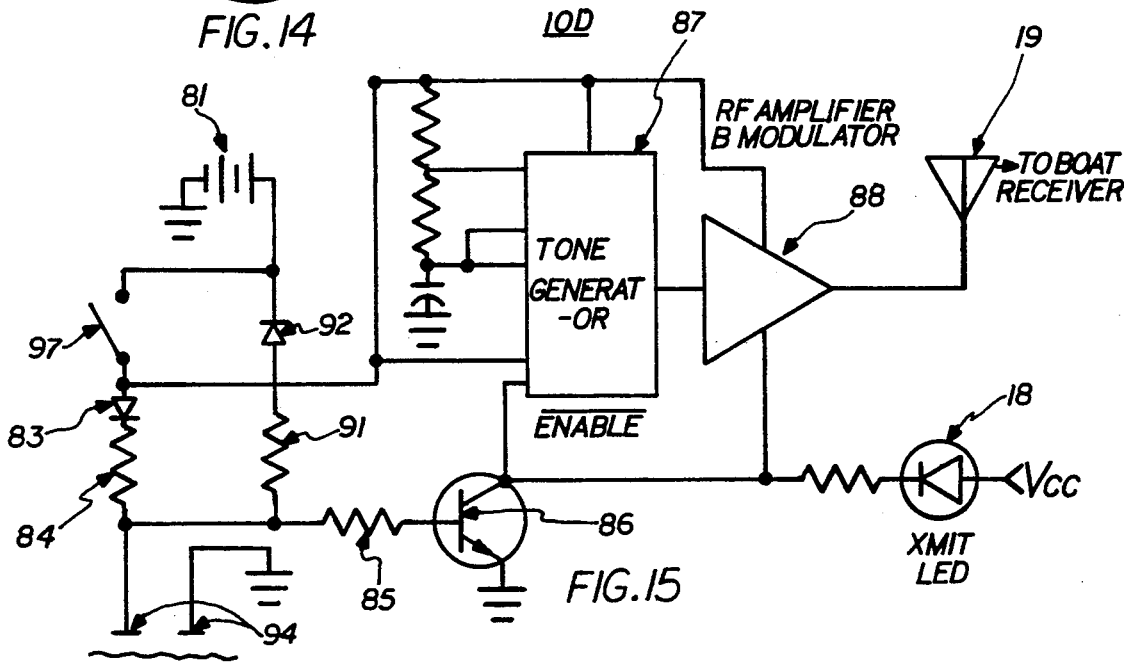
FIG. 15 is an electronic schematic of another embodiment of the alarm actuator circuit of the present invention.
Figure 16:
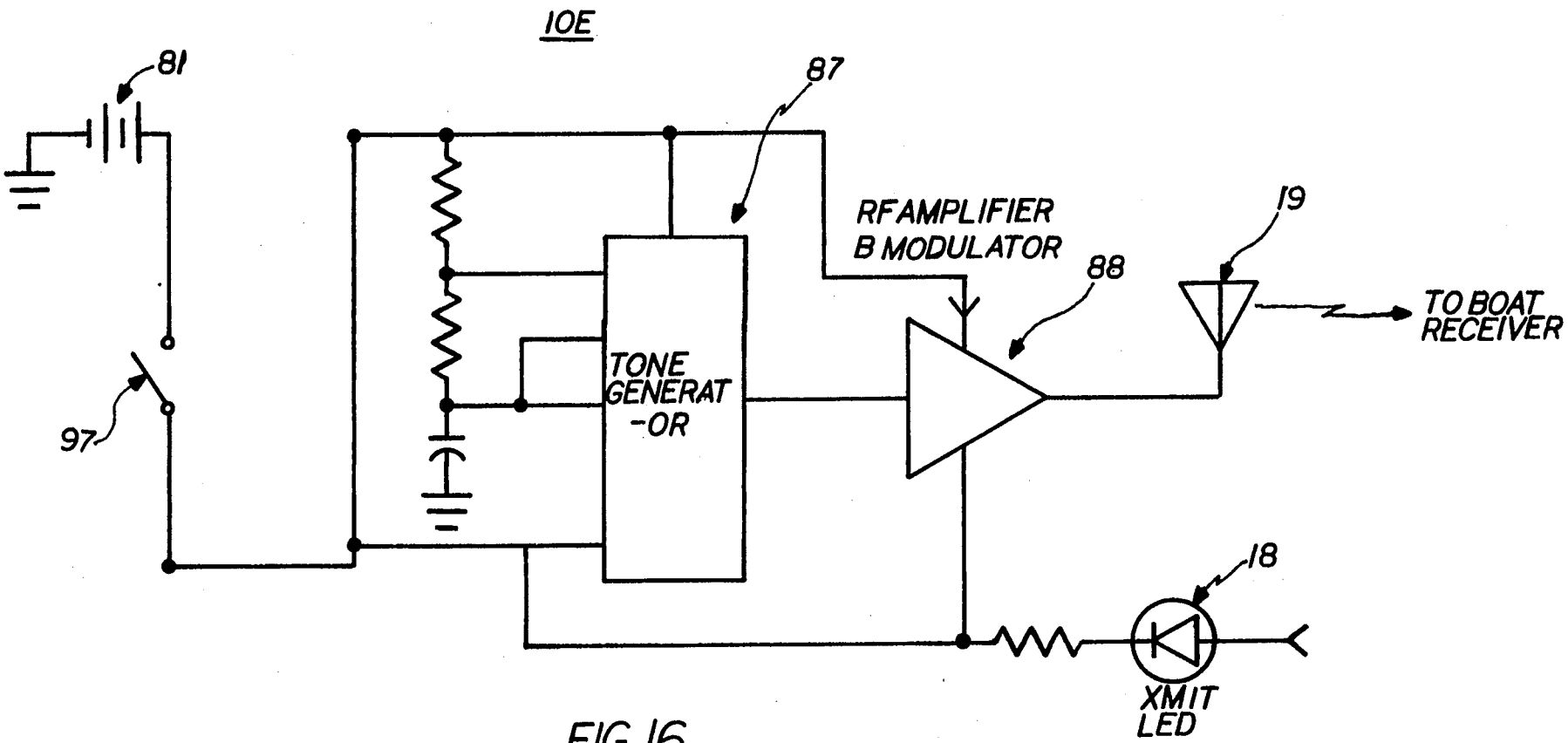
FIG. 16 is an electronic schematic of another embodiment of the remote alarm actuator circuit of the present invention.

A further embodiment of the alarm actuator of the present invention is illustrated in FIGS. 13, 14 and 15, in which there is an alarm actuator 210 which comprises a rope-handle 7D, which further comprises a hollow tube 7U connected at each of two ends to the handle yoke 7Y (FIG. 1). Affixed inside the hollow tube 7U is an alarm actuator circuit 10D (FIG. 15) of the alarm actuator 210. It is preferred that the circuit 10D is enclosed in a water resistant casing and/or coating such as are the alarm actuators 10 and 110. Likewise, the circuit 10D may be substantially equivalent to circuit 10C (FIG. 6) of the alarm actuators 10 (FIGS. 1, 4 AND 5) and 110 (FIG. 8) and have substantially the same function, with the exception that the switch 17 and timer 82 of the circuit 10C is replaced by at least one microswitch 97, which is used to enable the circuit 10D of the alarm actuator 210 when the skier grasps the rope-handle 7D in the operable manner and thereby closes the microswitch 97, and to disable said alarm actuator circuit 10D when the skier releases the rope-handle 7D. A moveable gripping plate 93 is affixed along the length of the hollow tube 7U for actuating the microswitch 97 when the skier is gripping said rope-handle 7D. The gripping plate 93 is affixed to the hollow tube 7U via a water resistant spring like biasing means, such as a flexible adhesive foam 98, for biasing the inner surface of said gripping plate away from the outer surface of said hollow tube 7U, and thereby biasing the microswitch 97 in an open circuit position. A skier-down situation is detected when the water skier releases the rope-handle 7D and is no longer exerting pressure on the gripping plate 93, or when an electrical current is established through the water across a pair of sensor plates 94 when the handle 7D is submerged in water, and the tow-boat operator is automatically alerted via the consequential actuation of the switching circuit 20S of the operator alarm unit 20. With this embodiment of the present invention, the tow-boat operator is automatically alerted and the visible skier-down indicators are automatically displayed for warning nearby boaters when either the water skier releases the rope-handle 7D, or when the water skier falls into the water without releasing said rope-handle 7D.

Still yet another embodiment of the alarm actuator of the present invention is further provided which is similar to actuator 210 (FIGS. 13, 14 and 15), but does not include the sensor plates 94 or the circuitry elements associated with said sensor plates 94. Provided in this embodiment is an alarm actuator 310 (not shown, but which appears substantially as the alarm actuator 210 without said sensor plates 94), which includes a circuit 10E (FIG. 16) and a rope handle 7E (not illustrated, but substantially similar to the rope-handle 7D of actuator 210 without said sensor plates 94). With alarm actuator 310, the tow-boat operator is automatically alerted, and the visible skier-down indicators are automatically displayed for warning nearby boaters, when the water skier releases the rope-handle 7E. The absence of said sensor plates 94 and the associated sensor plate circuitry elements in the actuator 310 provides a reduction in the manufacturing costs associated with the alarm actuator of the present invention. However, operation of this embodiment is based on the assumption that every water skier who falls automatically releases the skier rope-handle 7E, which has been noted as not necessarily being a valid assumption, especially with regard to beginning skiers. Because of this, it is not preferred that this embodiment of the alarm actuator 310 be used with beginning skiers.

Figure 17:
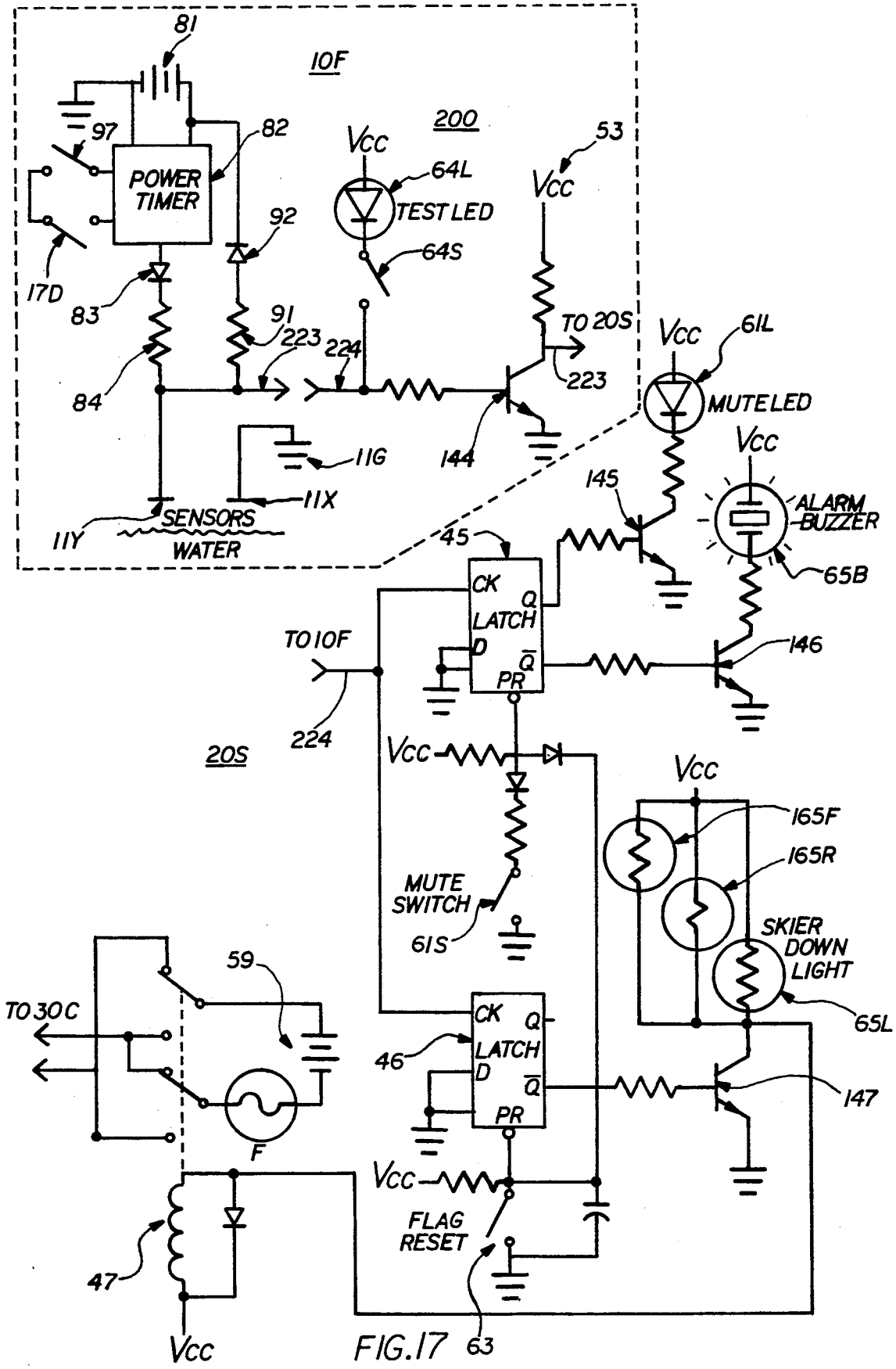
FIG. 17 is an electronic schematic of another embodiment of the remote alarm actuator- and tow-boat operator alarm-circuits of the present invention, including circuitry for controlling various visual alarms for warning other boat operators.

An electronic schematic of an alarm actuator circuit 10F and the corresponding switching circuit 20S of still another embodiment of the downed water skier warning system of the present invention is illustrated in FIG. 17. In this embodiment is a system 200 in which is provided an alarm actuator 10F within a rope-handle 7F (not shown, but which is substantially similar to the rope-handle 7D illustrated in FIGS. 13 and 14, except that it does not include a transmitter or associated transmitter circuitry), and an operator alarm unit 20F (not shown, but which is substantially similar to the alarm unit 20 illustrated in FIGS. 1,2 and 7, except that it does not include an antenna conductor 21 or the associated receiver circuit 20R). The alarm actuator circuit 10F is electrically connected to the switching circuit 20S via a first conductor or wire 223 which is elastically woven into the tow-rope 6 and connected at the stem 5S of the tow-boat 5 to a second conductor or wire 224 for final connection to said circuit 20S. It is preferred that said conductor be loosely intertwined within the tow-rope 6, such that said conductor expands and contracts in conjunction with the expansion and contraction of said tow-rope 6. In this embodiment, the power ON-OFF switch is a microswitch 97 electrically connected in linear relationship with a motion detector switch 17D which is similar to the motion detector switches of alarm actuator 10 (FIG. 9). When the microswitch 97 is closed by a skier picking up and holding the rope handle 7F, and the motion detector switch 17D is closed by suitable movements of said rope-handle 7F, the timer 82 is actuated for enabling a current between said circuits 10F and 20S and for beginning a "count-down" toward disenabling said current. Said timer 82 is reactuated each time said suitable movements for closing the motion detector switch 17D occur while the microswitch remains closed via the rope-handle 7F remaining in the skier's grip. Upon release of the rope-handle 7F by the skier, or the fall of said skier into the water and thereby creating a current across water sensors 11Y and 11X, the current between the circuit 10F and 20S is disabled, thereby allowing current from voltage source 53 across the pair of data latches 45 and 46 for actuating the audible and visual skier-down alarms 65B and 65L and the warning lights 165R and 165F, and establishing a current across the latch relay 47 to enable the electric motor 32 of the flag-mount 30 for causing the skier-down flag 8 to move from the down position 8D to the up position 8U, substantially similar to the embodiments of the circuits 20S and 30C of the system 100 illustrated in FIG. 7. Actuation of the reset switch 63 of the alarm unit 20F precipitates results which are substantially similar to those of the circuits 20S and 30C of the alarm unit 20 (FIG. 7).

Figure 18:
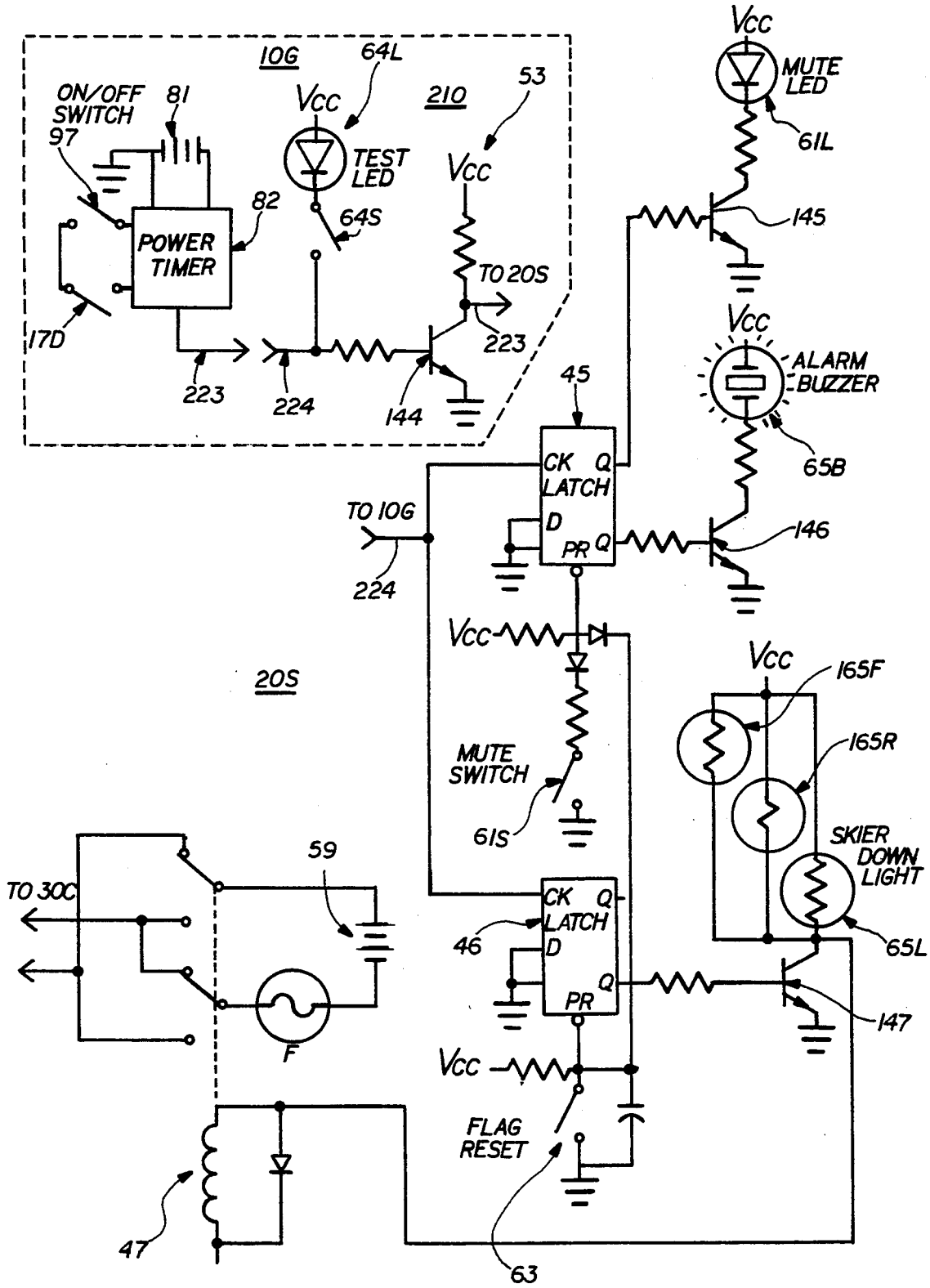
FIG. 18 is an electronic schematic of still another embodiment of the remote alarm actuator, tow-boat operator alarm and control box of the present invention, including circuitry for controlling various visual alarms for warning other boat operators.

An electronic schematic of an alarm actuator circuit 10G of another embodiment of the downed water skier warning system of the present invention for enabling the tow-boat operator alarm is illustrated in FIG. 18. In this embodiment is provided a downed water skier system 210 which is substantially similar to that of the system 200 illustrated in FIG. 17 and described above, but without the water sensors 11Y and 11X or the associated water sensor circuitry. In the system 210 is provided an alarm actuator 10G within a rope-handle 7G (not shown, but which is substantially similar to the rope-handle 7D illustrated in FIGS. 13 and 14, except that it includes neither a transmitter with associated transmitter circuitry, nor water sensors with associated water sensor circuitry), and an operator alarm unit 20G (not shown, but which is substantially similar to the alarm unit 20 illustrated in FIGS. 1,2 and 7, except that it does not include an antenna conductor 21 or the associated receiver circuit 20R). Operation of this embodiment of the present invention is likewise substantially similar to that of the embodiment illustrated in FIG. 17, with the exception being that the timer 82 is not reactuated merely when the skier falls and the rope-handle 7G thereby lands in the water along with the skier. Because there are no water sensors in this embodiment of the present invention, the skier must actually release the rope-handle 7G and thereby open the microswitch 97, or prevent movement of the rope-handle 7G suitable for closing the motion detector switch 17D, in order to allow current from voltage source 53 across the data latches 45 and 46 for actuating the audible and visual skier-down alarms 65B and 65L and the warning lights 165R and 165F, and enabling the electric motor 32 of the flag-mount 30. Actuation of the reset switch 63 and the resultant system actions are likewise substantially similar to that of the circuits 20S and 30C of the system 100 (FIG. 7).

Figure 19:
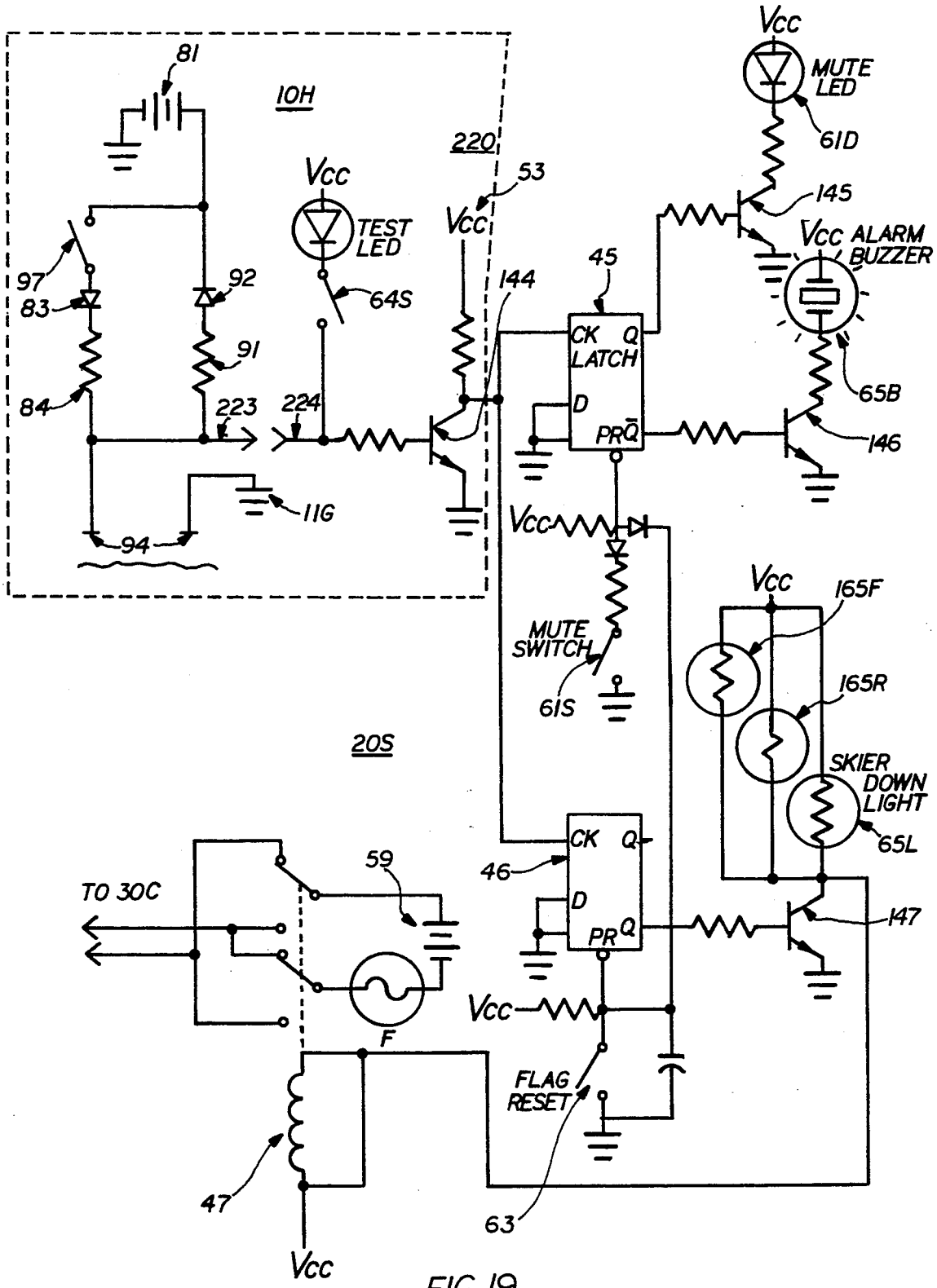
FIG. 19 is an electronic schematic of yet another embodiment of the remote alarm actuator, tow-boat operator alarm and control box of the present invention, including circuitry for controlling various visual alarms for warning other boat operators.

An electronic schematic of alarm actuator circuit 10H of still another embodiment of the downed water skier warning system of the present invention for enabling the tow-boat operator alarm is illustrated in FIG. 19. In this embodiment is provided a downed water skier system 220 which is likewise substantially similar to that of the system 200 illustrated in FIG. 17 and described above, but without the timer 82 or the motion detector switch 17D. In the system 220 is provided an alarm actuator 10H within a rope-handle 7H (not shown, but which is substantially similar to the rope-handle 7D illustrated in FIGS. 13 and 14, but with circuit 10H), and an operator alarm unit 20G (not shown, but which is substantially similar to the alarm unit 20 illustrated in FIGS. 1,2 and 7, except that it does not include an antenna conductor 21 or the associated receiver circuit 20R). The power ON-OFF switch of the circuit 10H is a microswitch 97 which is closed for enabling a current between said circuits 10H and 20S when a skier picks up and holds the rope-handle 7. Upon release of the rope-handle 7 by the skier, or the fall of said skier into the water, a current is established through the water and across the water sensors 11Y and 11X and the current between the circuits 10H and 20S is disabled, thereby allowing current from voltage source 53 to be established across the pair of data latches 45 and 46 for actuating the audible and visual skier-down alarms 65B and 65L and the warning lights 165R and 165F, and for enabling the electric motor 32 of the flag-mount 30. Actuation of the reset switch 63 precipitates results substantially similar to that of the circuits 20S and 30C of the circuit 20C illustrated in FIG. 7.

Figure 20:
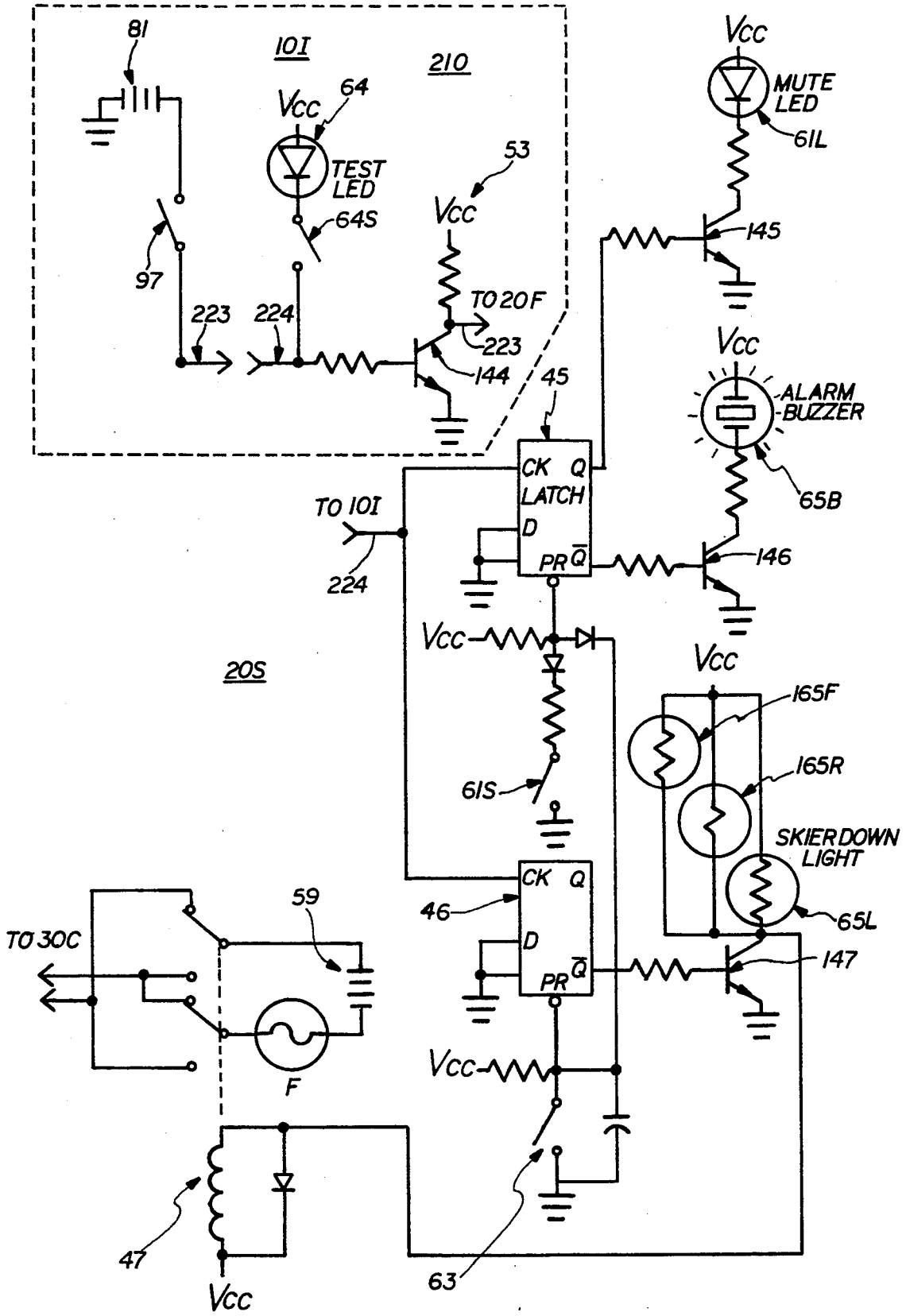
FIG. 20 is an electronic schematic of yet still another embodiment of the remote alarm actuator, tow-boat operator alarm and control box of the present invention.

An electronic schematic of alarm actuator circuit 10I of still another embodiment of the downed water skier warning system of the present invention for enabling the tow-boat operator alarm is illustrated in FIG. 20. In this embodiment is provided a downed water skier system 230 which is substantially similar to that of the system 210 illustrated in FIG. 18, but without the water sensors 11X and 11Y and the associated water sensor circuitry. The power ON-OFF switch of circuit 10I is a microswitch 97 which is closed for enabling a current between said circuits 10I and 20S when a skier picks up and holds the rope handle 6. Upon release of the rope-handle 6 by the skier, the current between the circuits 10I and 20S is disabled, thereby allowing current from voltage source 53 across the pair of data latches 45 and 46 for actuating the audible and visual skier-down alarms 65B and 65L and the warning lights 165R and 165F, and enabling the electric motor 32 of the flag-mount 30. Actuation of the reset switch 63 is likewise substantially similar to that of the circuits 20C and 30C of FIG. 7.

The inventor has given a non-limiting description of several embodiments of the present invention, to which many changes may be made without deviating from the spirit of the invention. While this invention has been described with reference to illustrative embodiments, this description is not intended to be construed in a limiting sense. Various modifications and combinations of the various embodiments as well as other embodiments of this invention will be apparent to a person skilled in the art upon reference to this description. It is therefore contemplated that the appended claims cover any such modifications and/or embodiments that fall within the true scope of the present invention.

It is claimed:

1. A downed water skier warning system for use with a tow-boat pulling a tow-rope having a rope-handle to which a water skier holds, the warning system comprising:

a transmitter circuit affixed to the tow-rope substantially adjacent to the rope-handle, four transmitting a signal;

said transmitter circuit including a water sensing circuit for disabling the transmitter circuit when the rope-handle is submerged in water; and means for indicating to the tow-boat operator that said rope-handle is submerged in water, responsive to the disabling of said transmitter circuit.

2. The downed water skier warning system of claim 1, wherein said means for indicating further comprises an operator alarm unit including an operator alarm circuit comprising:

a receiver circuit for receiving said signal from the remote alarm actuator; and a switching circuit responsive to said receiver circuit for actuating various operator alarm indicators and various warning indicators for being seen by operators of nearby boats.

3. The downed water skier warning system of claim 2, wherein the means for indicating further comprises:

a flag-mount circuit for raising a skier-down flag for warning operators of nearby boats when said rope-handle is submerged in water, responsive to said switching circuit.

4. The downed water skier warning system as recited in claim 1, further comprising:

means for sensing when a water skier being towed by the tow-boat releases the rope-handle;

means for indicating to the tow-boat operator when said skier releases said rope-handle, responsive to the disabling of said transmitter circuit; and means for warning operators of nearby boats, responsive to the disabling of said transmitter circuit.

5. The downed water skier warning system of claim 4, wherein the means for indicating further comprises:

at least one each audible and visual operator alarms responsive to said means for sensing; and a mute switch for selectively muting said audible operator alarms.

6. The downed water skier warning system of claim 4, wherein the means for warning further comprises a skier-down flag.

7. The downed water skier warning system of claim 6, wherein the skier-down flag is releasibly affixed to a flag-mount having a flag raising means responsive to the disabling of said transmitter circuit.

8. The downed water skier warning system of claim 7, wherein the flag-mount is mounted on a side of the boat for making said skier-down flag readily visible to nearby boat operators.

9. The downed water skier warning system of claim 1, wherein the transmitter circuit further comprises a timing circuit responsive to the water sensing circuit, for disabling the transmitter circuit after a predetermined amount of time has elapsed since the transmitter circuit has been actuated.

10. The downed water skier warning system of claim 9, wherein the transmitter circuit further comprises a motion detector switch, for resetting the timing circuit when the water skier moves the rope-handle beyond a predetermined range of motion.

11. A downed water skier warning system for use with a tow-boat pulling a tow-rope having a rope-handle to which a water skier holds, the warning system comprising:

a transmitter circuit affixed to the rope-handle for transmitting a signal;

said transmitter circuit including a water sensing circuit for disabling the transmitter circuit when the rope-handle is submerged in water; and means for indicating to the tow-boat operator when said rope handle is submerged in water, said indicating means being responsive to the disabling of said transmitter circuit.

12. The downed water skier warning system as recited in claim 11, further comprising means for warning operators of nearby boats responsive to the disabling of said transmitter circuit.

13. The downed water skier warning system of claim 12, wherein the means for warning further comprises a skier-down flag releasibly affixed to a flag-mount having a flag raising means responsive to the disabling of said transmitter circuit.

14. The downed water skier warning system of claim 11, wherein said transmitter circuit further comprises:

a hand-pressure sensing circuit affixed in the rope-handle for disabling said transmitter circuit when said hand-pressure sensing circuit detects the skier releasing the rope-handle, said hand-pressure sensing circuit and said transmitter circuit being electrically connected and formed as part of a remote alarm actuator circuit.

15. The downed water skier warning system of claim 14, wherein said hand-pressure sensing circuit comprises:

a microswitch connected between the rope-handle and a movable gripping plate, said gripping plate being affixed to said handle and biased away from said handle via a spring-like biasing means, and said microswitch further being responsive to the holding and releasing of the rope-handle by a water skier.

16. The downed water skier warning system of claim 14, wherein said means for indicating further comprises:

a receiver circuit for receiving said signal; and a switching circuit for actuating various operator alarm indicators and various warning indicators for being seen by operators of nearby boats, responsive to said receiver circuit.

17. The downed water skier warning system of claim 15, wherein the microswitch is electrically connected to said means for indicating.

18. The downed water skier warning system as recited in claim 9, including a skier down flag and means for raising said skier-down flag responsive to the disabling of said transmitter circuit, said means for raising including a flag-mount for mounting said skier-down flag on the tow-boat.

19. The downed water skier warning system as recited in claim 18, further comprising means for indicating to the operator of the tow-boat when the rope-handle is released, said means for indicating being responsive to the disabling of said transmitter circuit.

20. The downed water skier warning system as recited in claim 19, further comprising means for lowering said skier-down flag responsive to a switch affixed to the tow-boat and operable by the operator of the tow-boat, said means for lowering further being affixed to said flag mount.

* * * * *